US009070966B2

(12) United States Patent
Ng et al.

(10) Patent No.: US 9,070,966 B2
(45) Date of Patent: Jun. 30, 2015

(54) MULTI-BAND, WIDE-BAND ANTENNAS

(75) Inventors: Kok Jiunn Ng, Penang (MY); Kean Meng Lim, Kedah (MY)

(73) Assignee: Laird Technologies, Inc., Earth City, MO (US)

( * ) Notice: Subject to any disclaimer, the term of this patent is extended or adjusted under 35 U.S.C. 154(b) by 350 days.

(21) Appl. No.: 13/877,715

(22) PCT Filed: Oct. 5, 2010

(86) PCT No.: PCT/MY2010/000200

§ 371 (c)(1),
(2), (4) Date: Apr. 4, 2013

(87) PCT Pub. No.: WO2012/047085

PCT Pub. Date: Apr. 12, 2012

(65) Prior Publication Data

US 2013/0187820 A1 Jul. 25, 2013

(51) Int. Cl.
*H01Q 9/16* (2006.01)
*H01Q 5/02* (2006.01)
(Continued)

(52) U.S. Cl.
CPC ..... *H01Q 5/02* (2013.01); *H01Q 9/285* (2013.01); *H01Q 9/42* (2013.01); *H01Q 5/15* (2015.01); *H01Q 5/25* (2015.01); *H01Q 5/357* (2015.01); *H01Q 5/371* (2015.01)

(58) Field of Classification Search
USPC ..... 343/793, 795, 822, 700 MS
See application file for complete search history.

(56) References Cited

U.S. PATENT DOCUMENTS 7,439,914 B1 10/2008 Lin et al.
8,502,747 B2 * 8/2013 Chang et al. ..... 343/822
(Continued)

FOREIGN PATENT DOCUMENTS

CN 101388487 7/2012
TW 201010182 3/2010
(Continued)

OTHER PUBLICATIONS

International Search Report for PCT/MY2010/000200 dated May 30, 2011; 4 pages. The instant application is a US national phase of PCT/MY2010/000200.
(Continued)

*Primary Examiner* — Dieu H Duong
(74) *Attorney, Agent, or Firm* — Harness, Dickey & Pierce, P.L.C.

(57) ABSTRACT

Disclosed herein are various exemplary embodiments of multi-band, wide-band antennas. In exemplary embodiments, the antenna generally includes an upper portion and a lower portion. The upper portion includes two or more upper radiating elements and one or more slots disposed between the two or more upper radiating elements. The lower portion includes three or more lower radiating elements and one or more slots disposed between the three or more lower radiating elements. A gap is between the upper and lower portions such that the upper radiating elements are separated and spaced apart from the lower radiating elements. The antenna may be configured such that coupling of the gap and the upper and lower radiating elements enable multi-band, wide-band operation of the antenna within at least a first frequency range and a second frequency range, with the upper radiating elements operable as a radiating portion of the antenna, the lower radiating elements operable as a ground portion, and the gap operable for impedance matching.

20 Claims, 18 Drawing Sheets

(51) Int. Cl.

| | |
|---|---|
| ***H01Q 9/28*** | (2006.01) |
| ***H01Q 9/42*** | (2006.01) |
| ***H01Q 5/15*** | (2015.01) |
| ***H01Q 5/25*** | (2015.01) |
| ***H01Q 5/357*** | (2015.01) |
| ***H01Q 5/371*** | (2015.01) |

(56) References Cited

U.S. PATENT DOCUMENTS

| | | | | |
|---|---|---|---|---|
| 8,982,006 | B2 * | 3/2015 | Wang et al. | 343/821 |
| 2004/0075609 | A1 | 4/2004 | Li | |
| 2005/0035919 | A1 | 2/2005 | Yang et al. | |
| 2006/0017622 | A1 | 1/2006 | Zinanti et al. | |
| 2006/0022888 | A1 | 2/2006 | Cheng | |
| 2007/0164906 | A1 | 7/2007 | Tsai | |
| 2008/0198084 | A1 | 8/2008 | Yeap | |
| 2008/0266202 | A1 | 10/2008 | Lin et al. | |
| 2009/0115679 | A1 | 5/2009 | Chou et al. | |
| 2009/0128439 | A1 * | 5/2009 | Su et al. | 343/795 |
| 2010/0045556 | A1 | 2/2010 | Wong et al. | |

FOREIGN PATENT DOCUMENTS

| | | |
|---|---|---|
| WO | WO 2010/029304 | 3/2010 |
| WO | WO 2012/047085 | 4/2012 |

OTHER PUBLICATIONS

Ting-Wei Kang et al.•, Internal Printed Loop/Monopole Combo Antenna for LTE/GSM/UMTS Operation in the Laptop Computer; Microwave and Optical Letters, vol. 52, No. 7, Jul. 2010; 6 pages.

Chih-Hsien Wu et al.•, Printed Compact S-Shaped Monopole Antenna With a Perpendicular Feed for Penta-Band Mobile Phone Application, Microwave and Optical Letters, vol. 49, No. 12, Dec. 2007; 6 pages.

Chinese Office Action dated Dec. 4, 2013 for Chinese patent application No. 201110294912.0 (published as CN102544701) which claims priority to the same parent application as the instant application; 10 pages.

Supplementary European Search Report and Preliminary Opinion for European patent application No. 10858201.6 (published as EP2625744) which claims priority to the same parent application as the instant application; dated Jan. 29, 2014; 7 pages.

* cited by examiner

MULTI-BAND, WIDE-BAND ANTENNAS

CROSS REFERENCE TO RELATED APPLICATION

This application is a National Stage of PCT International Application No. PCT/MY2010/000200 filed Oct. 5, 2010 (Publication No. WO 2012/047085). The disclosure of the above application is incorporated herein by reference in its entirety.

FIELD

The present disclosure relates to multi-band, wide-band antennas.

BACKGROUND

This section provides background information related to the present disclosure which is not necessarily prior art.

Wireless application devices, such as laptop computers, cellular phones, etc. are commonly used in wireless operations. Consequently, additional frequency bands are required to accommodate the wide range of wireless application devices, and antennas capable of handling the additional different frequency bands are desired.

SUMMARY

This section provides a general summary of the disclosure, and is not a comprehensive disclosure of its full scope or all of its features.

Disclosed herein are various exemplary embodiments of multi-band, wide-band antennas. In exemplary embodiments, the antenna generally includes an upper portion and a lower portion. The upper portion includes two or more upper radiating elements and one or more slots disposed between the two or more upper radiating elements. The lower portion includes three or more lower radiating elements and one or more slots disposed between the three or more lower radiating elements. A gap is between the upper and lower portions such that the upper radiating elements are separated and spaced apart from the lower radiating elements. The antenna may be configured such that coupling of the gap and the upper and lower radiating elements enable multi-band, wide-band operation of the antenna within at least a first frequency range and a second frequency range, with the upper radiating elements operable as a radiating portion of the antenna, the lower radiating elements operable as a ground portion, and the gap operable for impedance matching.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
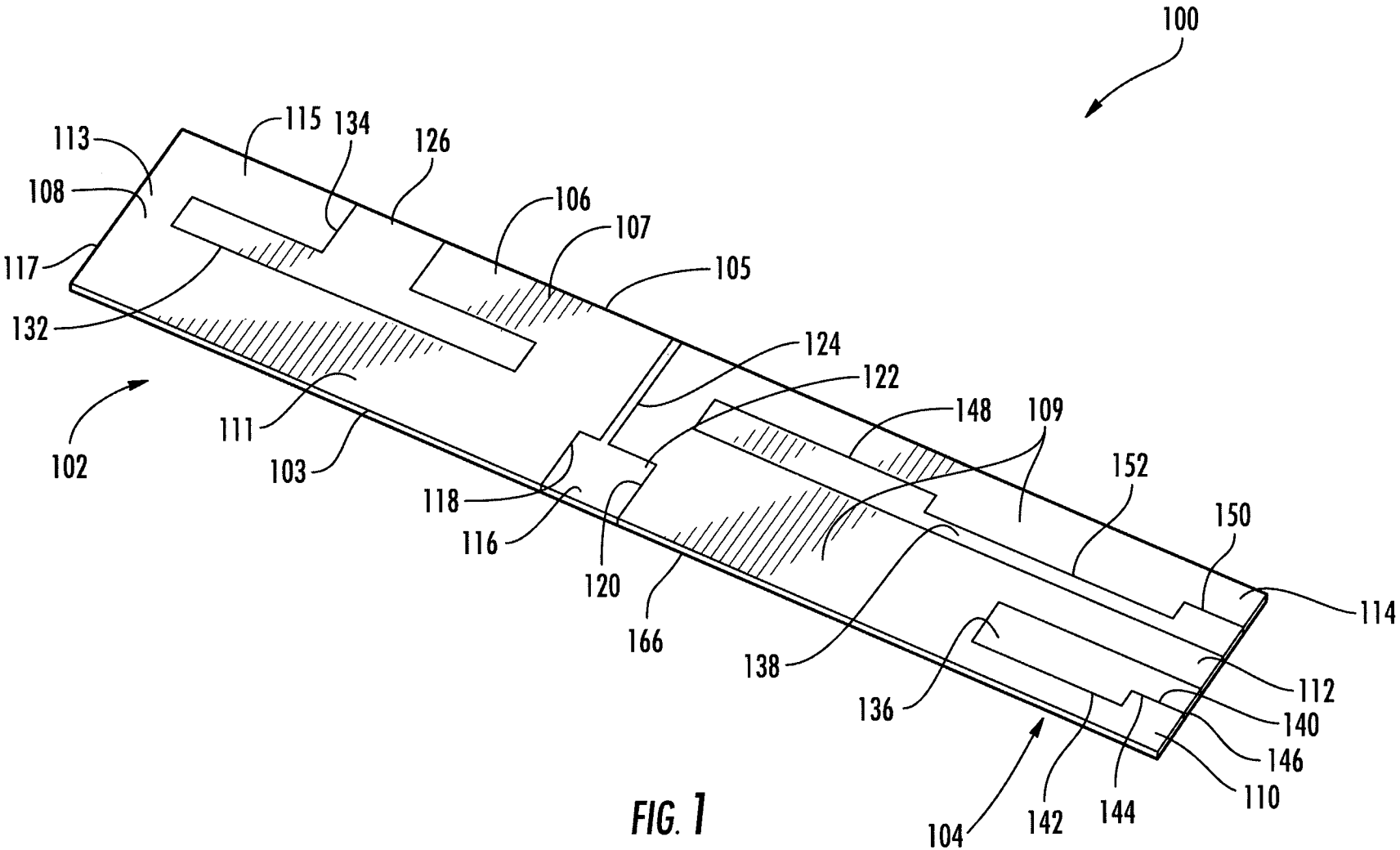
FIG. 1 illustrates an example embodiment of a multi-band, wide-band antenna including one or more aspects of the present disclosure.

Example embodiments will now be described more fully with reference to the accompanying drawings.

The inventors have recognized a need for antennas designed to be multi-band and wide-band for wireless communications systems. But designing multi-band, wide-bands antenna is an especially challenging task for frequency bands that are far apart.

Despite this, the inventors hereof have disclosed various exemplary embodiments of a multi-band, wide-band antenna (e.g., antenna 100 (FIG. 1), antenna 200 (FIG. 19), antenna 300 (FIG. 20), antenna 400 (FIG. 21), etc.) that include multiple radiating elements on upper and lower portions of the antenna, such that the antenna is operable essentially as or similar to a dipole antenna starting from as half wavelength dipole for a first frequency range and various different order wavelength dipole for a second frequency range. The antenna may include two upper radiating arms corresponding to or defining the radiating portion. The antenna may also include three lower radiating arms corresponding to or defining the ground portion. Coupling among the radiating arms and a gap between the upper and lower portions of the antenna may allow the antenna to resonate at, operate at, or be capable of covering multiple frequency bands, such as a first frequency band of 698 megahertz to 960 megahertz and a second frequency band of 1710 megahertz to 3800 megahertz. Antennas disclose herein may also support 3rd Generation Partnership Project (3GPP) Long Term Evolution (LTE) applications.

In exemplary embodiments, a multi-band, wide-band antenna is configured to be operable or cover the frequencies or frequency bands listed immediately below in Table 1.

TABLE 1

| Band Number | System/Band Description | Upper Frequency (MHz) | Lower Frequency (MHz) |
|---|---|---|---|
| 1 | 700 MHz Band | 698 | 862 |
| 2 | AMPS/GSM 850 | 824 | 894 |
| 3 | GSM 900 (E-GSM) | 880 | 960 |
| 4 | DCS 1800/GSM 1800 | 1710 | 1880 |
| 5 | PCS 1900 | 1850 | 1990 |
| 6 | W CD MA/UMTS | 1920 | 2170 |
| 7 | 2.3 GHz Band IMT Extension | 2300 | 2400 |
| 8 | IEEE 802.11B/G | 2400 | 2500 |
| 9 | W IMAX MMDS | 2500 | 2690 |
| 10 | BROADBAND RADIO SERVICES/BRS (MMDS) | 2700 | 2900 |
| 11 | W IMAX (3.5 GHz) | 3400 | 3600 |
| 12 | PUBLIC SAFETY RADIO | 4940 | 4990 |

In exemplary embodiments, a multi-band, wide-band antenna may be operable for covering all of the above-listed frequency bands with good voltage standing wave ratios (VSWR) and with relatively good gain. For example, an exemplary embodiment of a multi-band, wide-band antenna is operable for covering all of the above-listed frequency bands with relatively good gain with a VSWR less than 2.5 at the lower bands (698 MHz to 960 MHz), with a VSWR less than 2 for the higher bands (1710 MHz to 5000 MHz), and with a VSWR less than 2.5 for frequencies within a band from 5000 MHz to 6000 MHz. By way of background, VSWR is a ratio of maximum voltage to minimum voltage. VSWR generally measures how efficiently radio frequency power is being transmitted to an antenna (e.g., from a power source, through a transmission line, and to the antenna). Alternative embodiments may include an antenna having different operating characteristics (e.g.; a different VSWR at a particular frequency, different gain, etc.) at these frequencies and/or be operable at less than all of the above-identified frequencies and/or be operable at different frequencies than the above-identified frequencies.

In some embodiments, the multi-band, wide-band antenna may be fabricated on a single sided substrate. That is, the radiating elements of the antenna may all be supported (e.g., mounted, coupled to, etc.) on the same side of the substrate. Having the radiating elements on the same side of the substrate eliminates the need for a double-sided printed circuit board. The antenna's radiating elements may be fabricated or provided in various ways and supported by different types of substrates and materials, such as a circuit board, a flexible circuit board, a plastic carrier, Flame Retardant 4 (FR4), flex-film, etc. An exemplary embodiment includes an FR4 substrate having a length of about 150 millimeters, a width of about 30 millimeters, and a thickness of about 0.80 millimeters. Alternative embodiments may include a substrate with a different configuration (e.g., different shape, size, material, etc.). The materials and dimensions provided herein are for purposes of illustration only as an antenna may be configured from different materials and/or with different shapes, dimensions, etc. depending, for example, on the particular frequency ranges desired, presence or absence of a substrate, the dielectric constant of any substrate, space considerations, etc.

The multi-band, wideband antennas disclosed herein may be fed in various ways. In an exemplary embodiment, a coaxial cable is coupled (e.g., soldered, etc.) to the antenna for feeding the antenna by soldering an inner or center conductor of the coaxial cable to a feed location of the upper radiating portion of the antenna and by soldering the outer conductor or braid of the coaxial cable to the lower/ground portion of the antenna. In some embodiments, the feed cable may be terminated with a connector (e.g., SMA (SubMiniature Type A) connector, MMCX (micro-miniature coaxial) connector, MCC or mini coaxial connector, U.FL connector, etc.) for connecting to an external antenna connector of a wireless application device or portable terminal. Such embodiments permit the antenna to be used with any suitable wireless application device or portable terminal without needing to be designed to fit inside the wireless application device housing or portable terminal. Alternative embodiments may include other feeding arrangements, such as other types of feeds besides coaxial cables and/or other types of connections besides soldering, such as snap connectors, press fit connections, etc.

Figure 15:
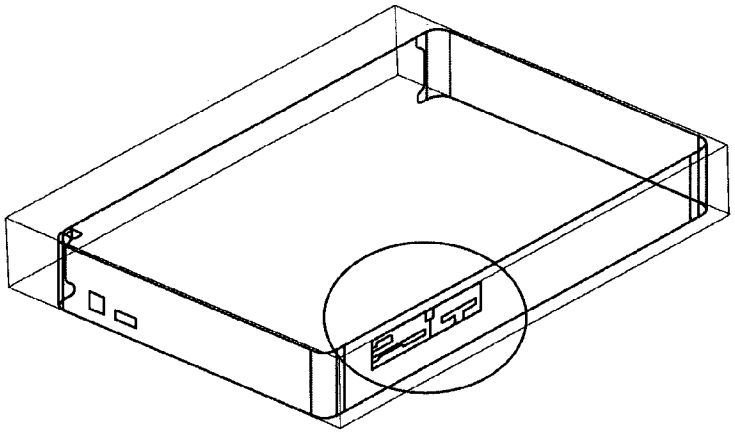
FIG. 15 illustrates an internal embedded antenna application in which the antenna shown in FIG. 1 may be used.
Figure 14:
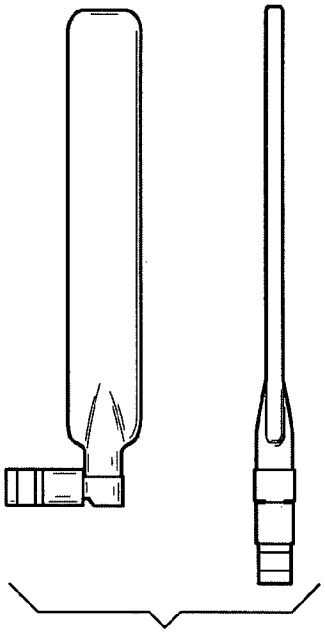
FIG. 14 illustrates an exemplary external blade antenna application in which the antenna shown in FIG. 1 may be used.
Figure 13:
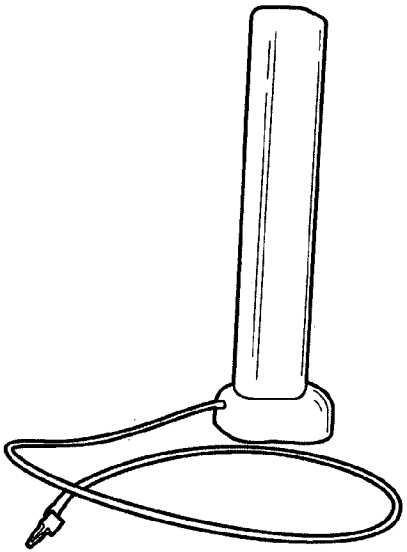
FIG. 13 illustrates an exemplary desktop antenna application in which the antenna shown in FIG. 1 may be used.
Figure 20:
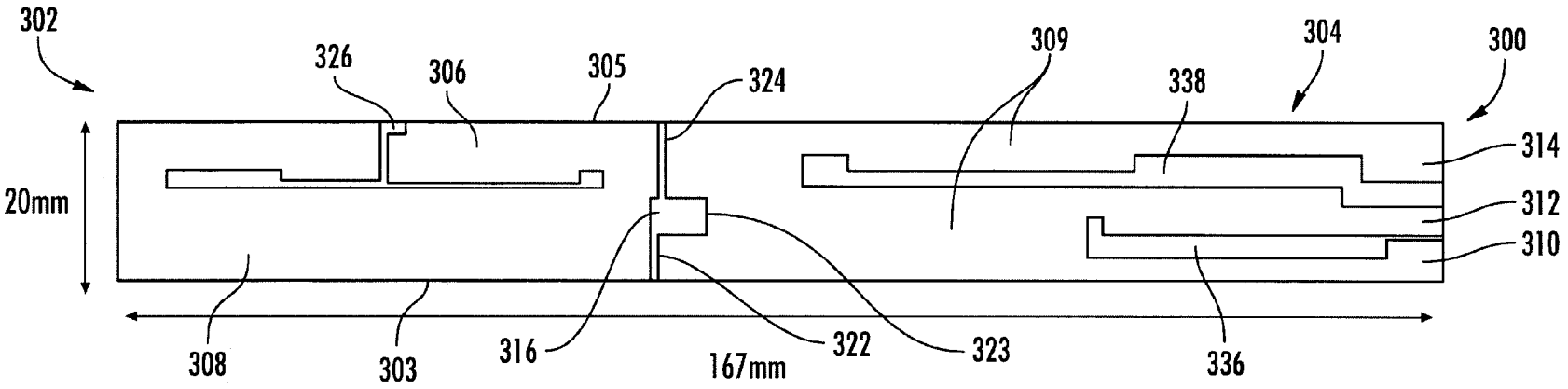
FIG. 20 illustrates another example embodiment of a multi-band, wide-band antenna including one or more aspects of the present disclosure.
Figure 21:
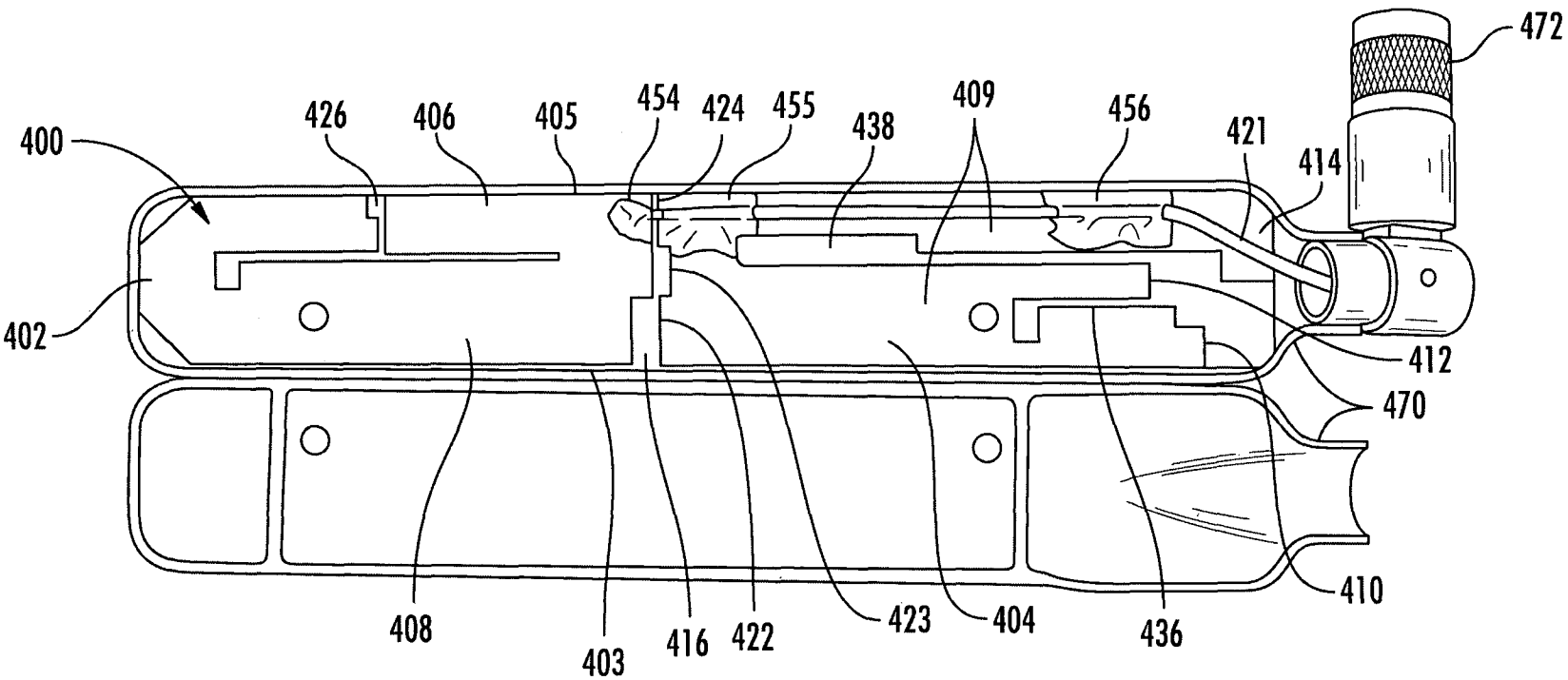
FIG. 21 illustrates another example embodiment of a multi-band, wide-band antenna with a coaxial cable coupled thereto for feeding the antenna and positioned within a housing or sheath, and configured for use an external blade antenna according to an exemplary embodiment.
Figure 22:
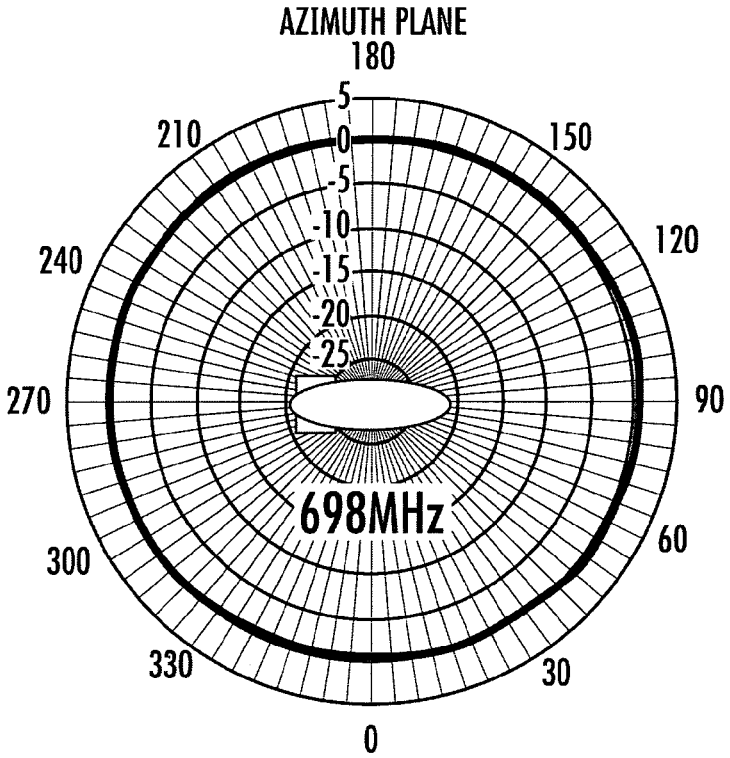
FIG. 22 illustrates radiation patterns (azimuth plane) measured for a prototype of the example antenna shown in FIG. 21 with a coaxial cable feed at a frequency of 698 megahertz.
Figure 23:
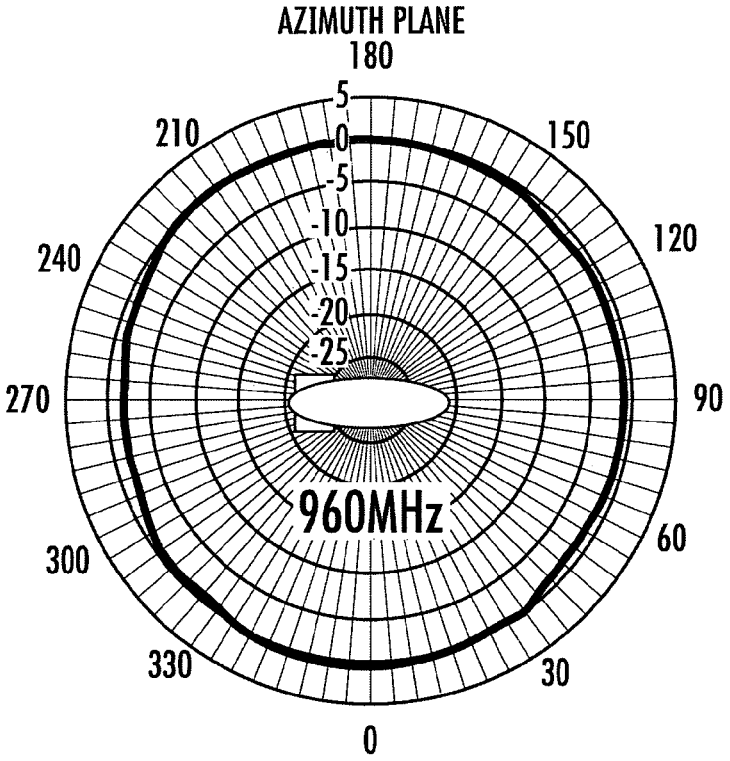
FIG. 23 illustrates radiation patterns (azimuth plane) measured for a prototype of the example antenna shown in FIG. 21 with a coaxial cable feed at a frequency of 960 megahertz.
Figure 24:
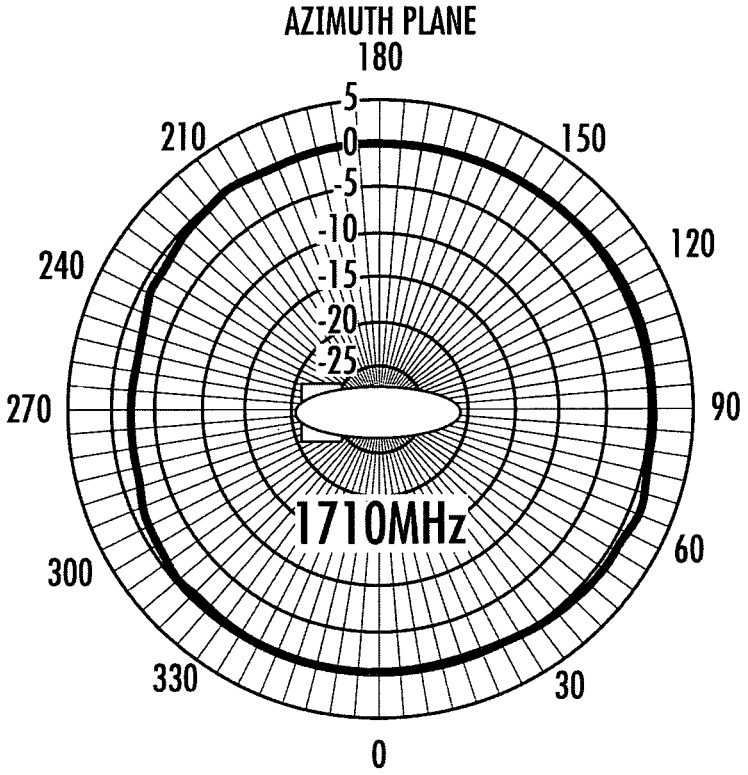
FIG. 24 illustrates radiation patterns (azimuth plane) measured for a prototype of the example antenna shown in FIG. 21 with a coaxial cable feed at a frequency of 1710 megahertz.
Figure 25:
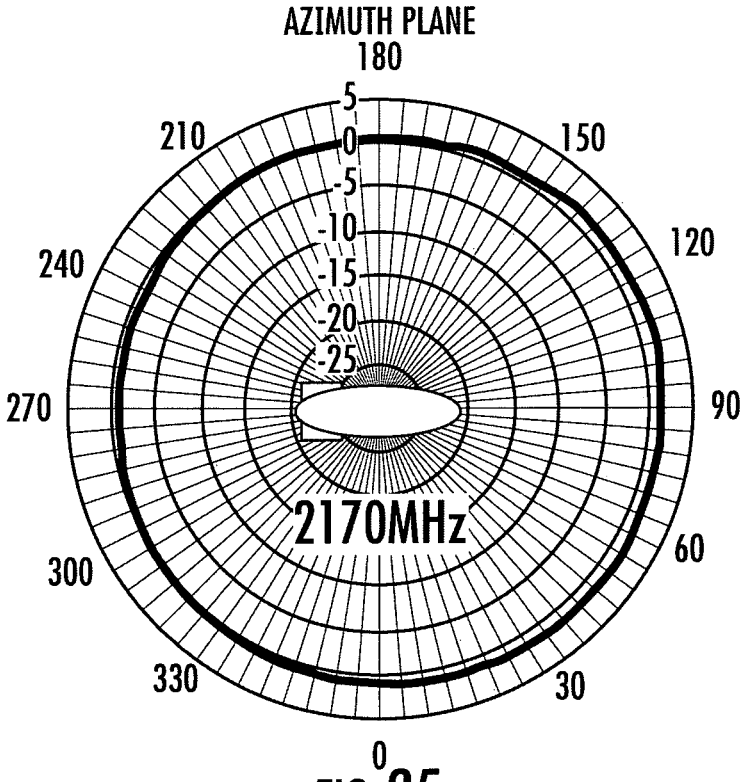
FIG. 25 illustrates radiation patterns (azimuth plane) measured for a prototype of the example antenna shown in FIG. 21 with a coaxial cable feed at a frequency of 2170 megahertz.
Figure 26:
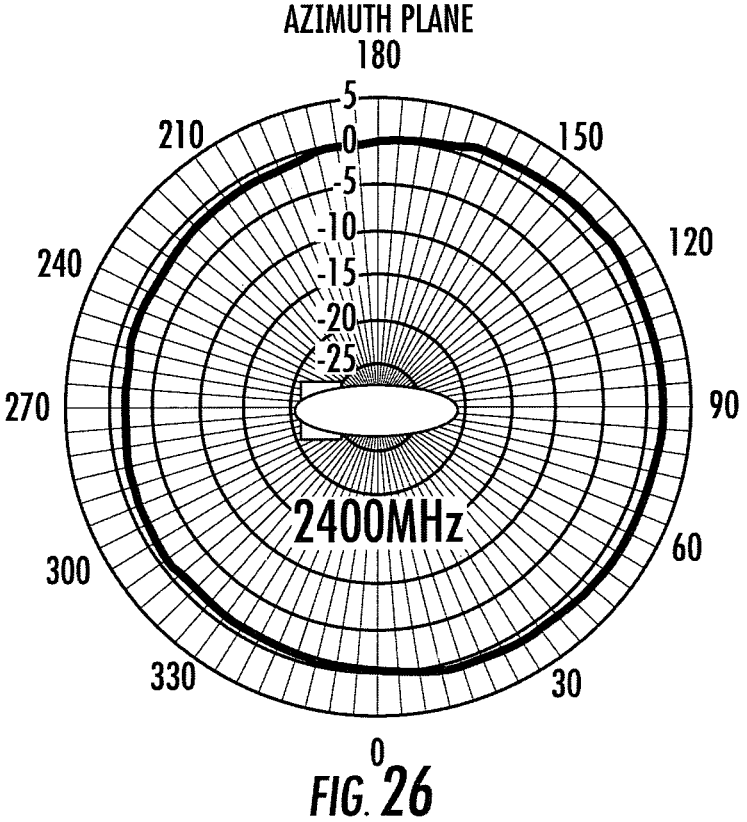
FIG. 26 illustrates radiation patterns (azimuth plane) measured for a prototype of the example antenna shown in FIG. 21 with a coaxial cable feed at a frequency of 2400 megahertz.
Figure 27:
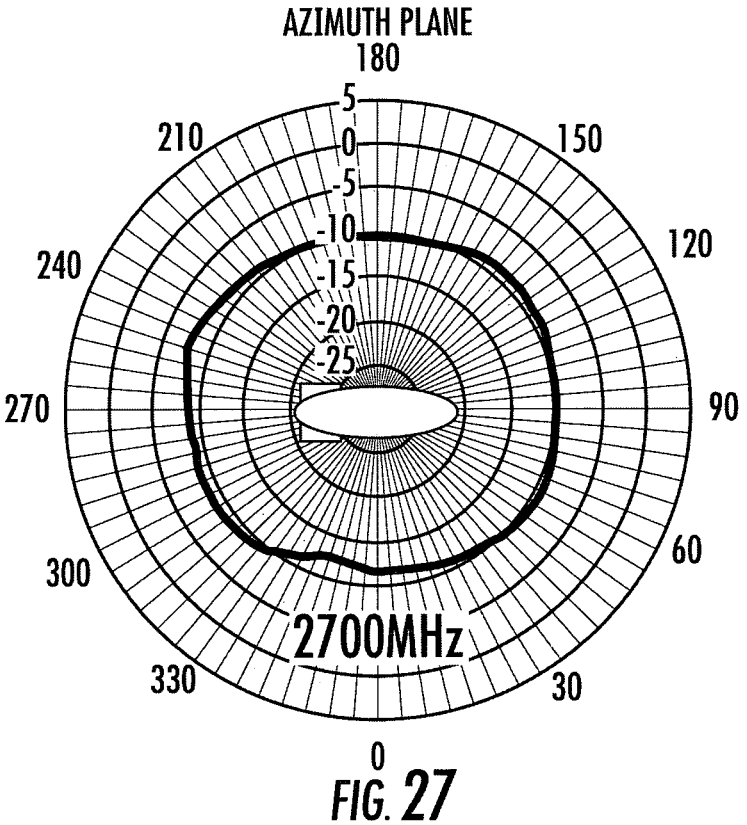
FIG. 27 illustrates radiation patterns (azimuth plane) measured for a prototype of the example antenna shown in FIG. 21 with a coaxial cable feed at a frequency of 2700 megahertz.

Depending on the particular application or intended end use, the multi-band, wide-band antenna may be configured for use as an internal antenna or as external antenna. Moreover, changes can be made to the antenna size, substrate, PCB (flexible or non-flexible), etc. to accommodate other frequency bands as well as to accommodate external applications, such as by having a sheath to cover the multi-band, wide-band antenna. By way of example, FIGS. 13 through 15 illustrate exemplary applications in which may be used one or more of the disclosed embodiments of a multiband, wide-band antenna, such as antenna 100 (FIG. 1), antenna 200 (FIG. 19), antenna 300 (FIG. 20), antenna 400 (FIG. 21), etc. More specifically, FIG. 13 illustrates a desktop antenna that may include a multiband, wide-band antenna. FIG. 14 illustrates an external blade antenna that may include a multiband, wide-band antenna. FIG. 15 illustrates a multiband, wide-band antenna as an internal embedded antenna. By way of further example, FIG. 21 illustrates an exemplary embodiment of an antenna assembly that includes a multiband, wide-band antenna 400 positioned within a housing or sheath 470 and with a coaxial cable 421 soldered 454, 455, 456 to feed points or soldering pads of the antenna 400. The coaxial cable 421 is connected to an external connector 472, which, in turn, may be used for connecting the antenna assembly to an electronic device, such as a handheld portable terminal, laptop or notebook computer, etc. The example antenna assembly illustrated in FIG. 21 may be used as an external blade antenna.

Exemplary embodiments of the multi-band, wide-band antenna may also be configured to be omnidirectional. In such embodiments, the multi-band, wide-band omnidirectional antenna may be useful for a variety of wireless communication devices because the radiation pattern allows for good transmission and reception from a mobile unit in all angles at azimuth plane. Generally, an omnidirectional antenna is an antenna that radiates power generally uniformly in one plane with a directive pattern shape in a perpendicular plane, where the pattern may be described as "donut shaped."

With reference now to FIG. 1, there is shown an exemplary embodiment of a multi-band, wide-band antenna 100 including one or more aspects of the present disclosure. The antenna 100 includes upper and lower portions 102, 104 having multiple radiating elements or arms. More specifically, the upper portion 102 includes two radiating elements or arms 106, 108. The lower portion 104 includes three radiating elements or arms 110, 112, 114.

The antenna's upper and lower portions 102, 104 and radiating elements 106, 108, 110, 112, 114 may be configured such that the antenna 100 is operable essentially as or similar to a standard half wavelength dipole antenna for a first frequency range (e.g., frequencies from 698 megahertz to 960 megahertz, etc.). At the first frequency range, the first and second upper radiating elements 106, 108 are operable as the radiating portion of the antenna 100, whereas the first, second, and third lower radiating elements 110, 112, 114 are operable as the ground portion of the antenna 100. At frequencies higher than the first frequency range such as at frequencies from 1710 megahertz to 3800 megahertz, the upper portion may operate or appear to be longer than a half wavelength dipole.

Figure 16:
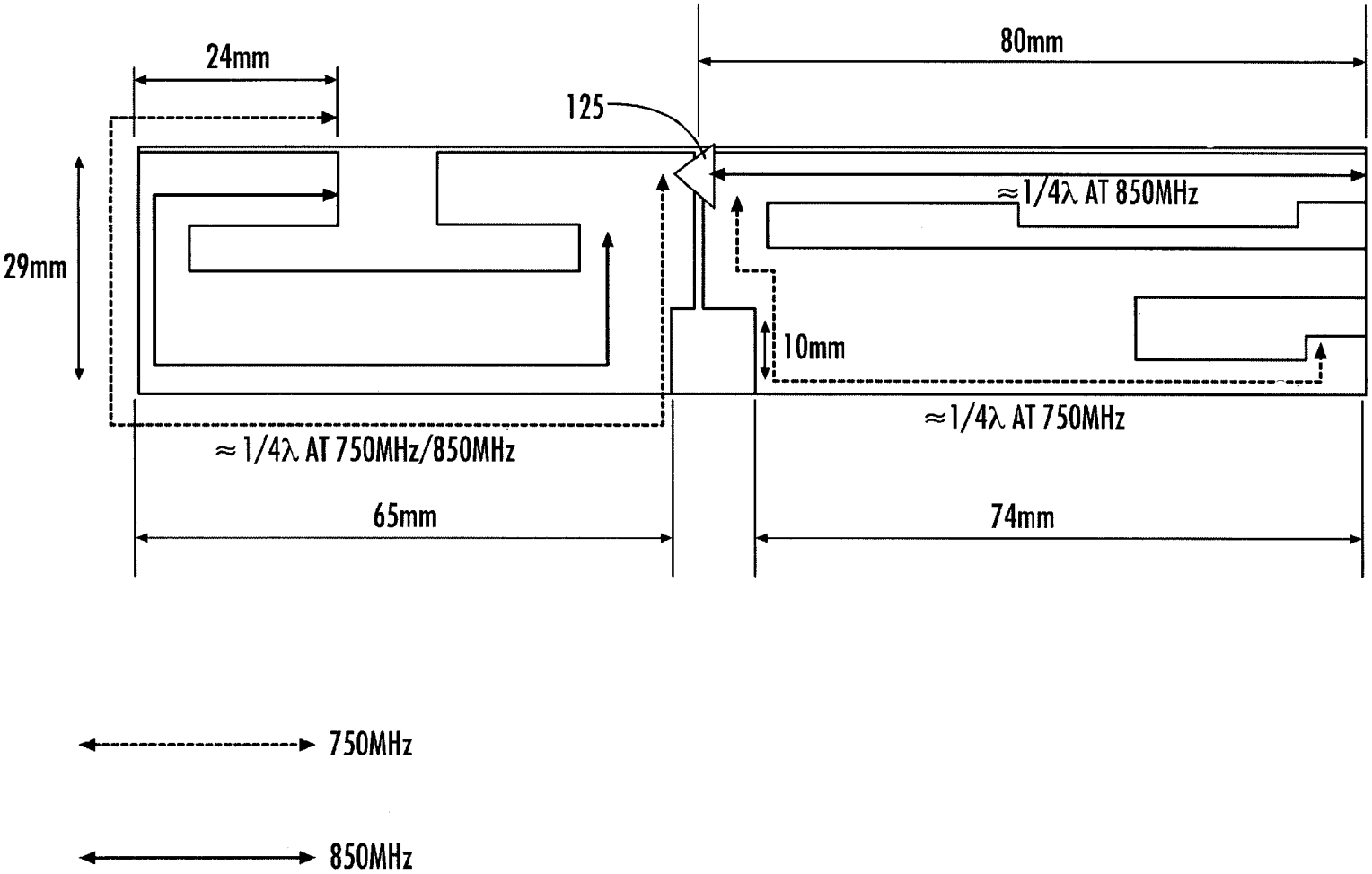
FIG. 16 illustrates the antenna shown in FIG. 1 with exemplary dimensions (in millimeters) and electrical lengths associated with the antenna's radiating elements at 750 megahertz and 850 megahertz, where these dimensions and electrical lengths are provided for purposes of illustration only according to exemplary embodiments.

In operation, the antenna 100 may be operable essentially as or similar to a standard half wavelength dipole antenna for frequencies falling within a first frequency range or band (e.g., frequencies from 698 megahertz to 960 megahertz, etc.) with the upper and lower portions 102, 104 each having an electrical length of about $\lambda/4$. Only radiating element 108 is essentially radiating for frequencies within the first frequency range for upper portion and having an electrical wavelength of about one quarter wavelength ($\lambda/4$) at 750 megahertz and at 850 megahertz. This is shown by way of example in FIG. 16. As shown in FIG. 16, the antenna 100 may be configured to be operable at 750 megahertz and at 850 megahertz with the radiating elements 110, 112, 114 of the lower portion 104 and the radiating element 108 of the upper portion 102 each having an electrical wavelength of about one quarter wavelength ($\lambda/4$).

Figure 17:
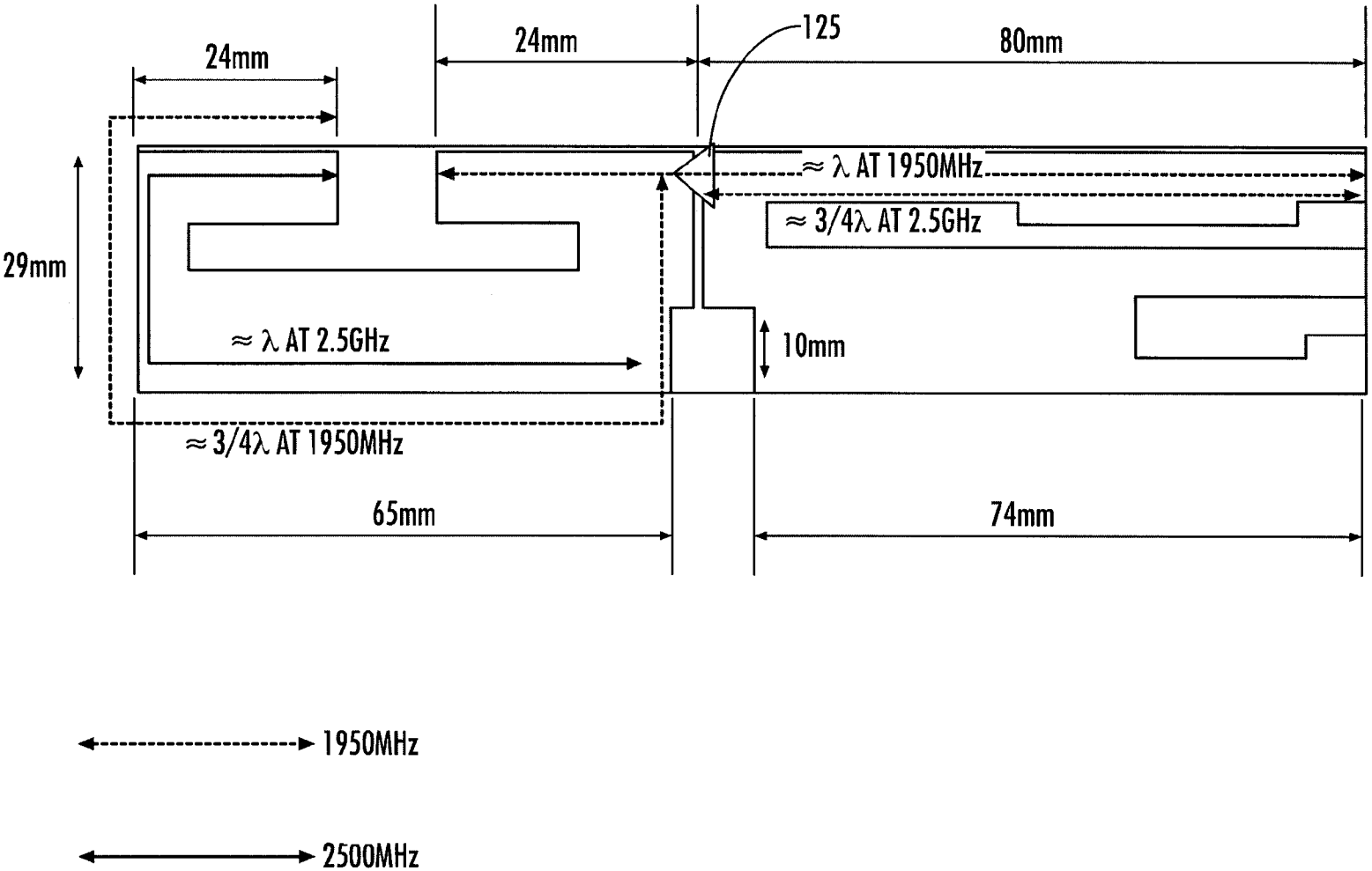
FIG. 17 illustrates the antenna shown in FIG. 1 with exemplary dimensions (in millimeters) and electrical lengths associated with the antenna's radiating elements at 1950 megahertz and 2500 megahertz, where these dimensions and electrical lengths are provided for purposes of illustration only according to exemplary embodiments.

For the higher frequencies within a second frequency range or high band (e.g., frequencies from 1710 megahertz to 3800 megahertz, etc.), both radiating elements 106, 108 of the upper portion 102 may be effective radiators. By way of example, FIG. 17 illustrates the antenna 100 and electrical lengths for the radiating elements at frequencies of 1950 megahertz and 2500 megahertz. As shown by FIG. 17, the antenna 100 may be operable at 1950 megahertz with the radiating element 108 of the upper portion 102 having an electrical wavelength of about three quarter wavelength ($3\lambda/4$) and with the radiating element 114 of the lower portion 104 and the radiating element 106 of the upper portion 102 having a combined electrical wavelength of about one wavelength ($\lambda$). At 2500 megahertz, the antenna 100 may be operable with the radiating element 108 of the upper portion 102 having an electrical wavelength of about one wavelength ($\lambda$) and with the radiating element 114 of the lower portion 104 having an electrical wavelength of about three quarter wavelength ($3\lambda/4$).

At the first and second frequency ranges, the lower portion 104 may be operable as ground, which permits the antenna 100 to be ground independent. Thus, the antenna 100 does not depend on a separate ground element or ground plane. At low band or the first frequency range (e.g., frequencies from 698 megahertz to 960 megahertz, etc.), the lower portion or planar skirt element 104 may have an electrical length of about one quarter wavelength ($\lambda/4$), as shown in FIG. 16 at frequencies of 750 and 850 megahertz.

Figure 2:
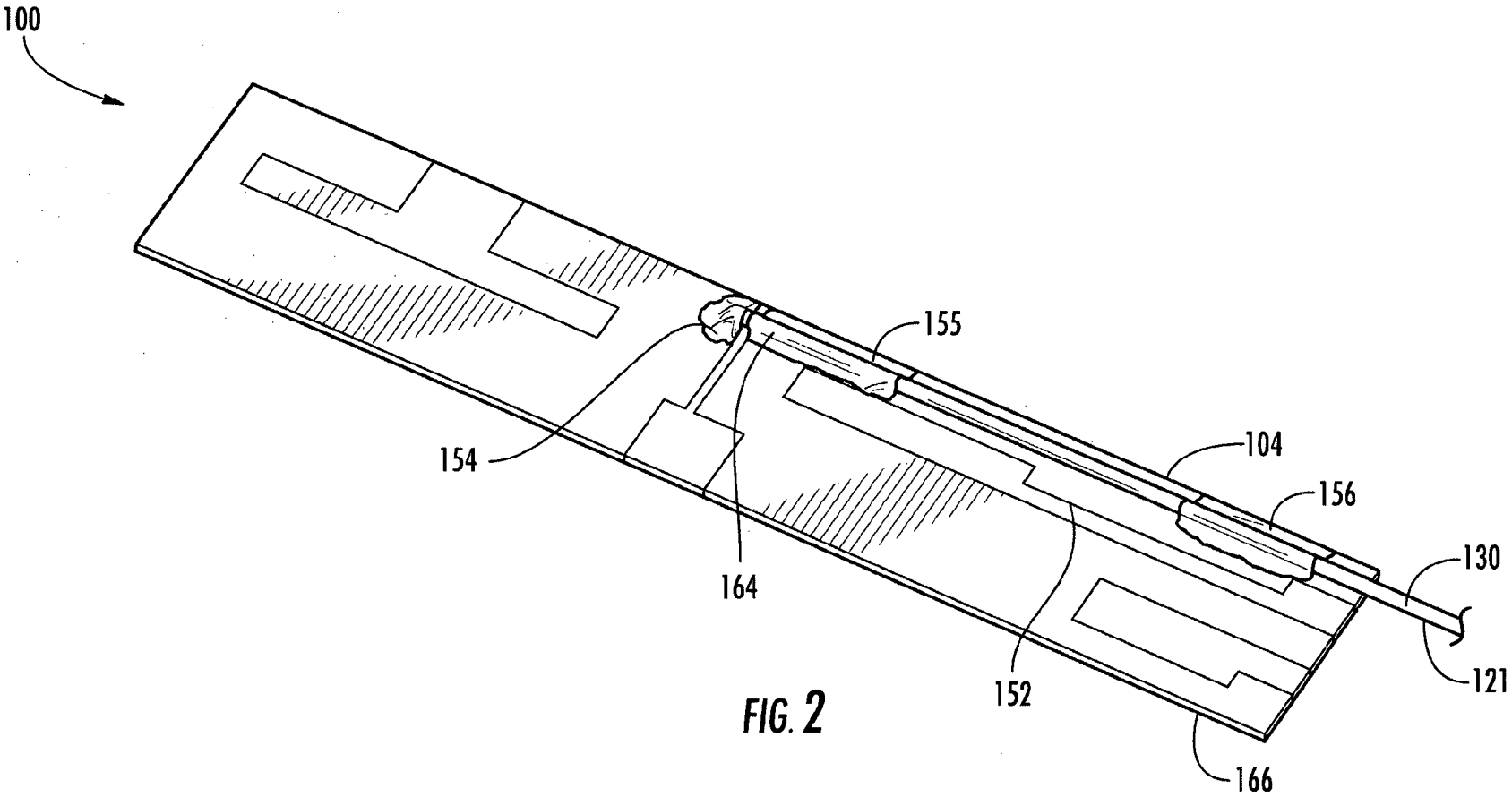
FIG. 2 illustrates the antenna shown in FIG. 1 with a coaxial cable coupled thereto for feeding the antenna according to an exemplary embodiment.

As shown in FIG. 2, the outer conductor 130 of a coaxial cable 121 may be connected (e.g., soldered, etc.) to the planar skirt element 104. The planar skirt element 104 may behave as a quarter wavelength ($\lambda/4$) choke at low band or the first frequency range. In which case, the current flow into the outer surface of the coaxial cable 121 is reduced. This allows the antenna 100 to operate essentially like a half wavelength dipole antenna ($\lambda/2$) at low band. Within the second frequency range or high band (e.g., frequencies from 1710 megahertz to 3800 megahertz, etc.), the lower portion 104 has a longer or different electrical length (e.g., about three quarter wavelength ($3\lambda/4$) at 2500 megahertz, etc.) than it does for frequencies within the first frequency range or low band. Thus, the lower portion 104 may be considered more like a radiating element than a sleeve choke at higher frequencies. This allows the antenna 100 to operate essentially like a long dipole antenna at some higher band frequencies like 2500 megahertz as shown by FIG. 17.

The antenna 100 also includes a gap 116 for impedance matching. The gap 116 is defined generally between the lower edge 118 of the first and second upper radiating elements 106, 108 and the upper edge 120 of the first, second, and third lower radiating elements 110, 112, 114. The upper and lower edges 118, 120 are spaced apart to define the gap 116.

As shown in FIG. 1, each of the upper and lower edges 118 and 120 have a step-like or step configuration. The stepped upper and lower edges 118, 120 provide the "step" gap 116 with first and second rectangular portions 122, 124. The first rectangular portion 122 extends from an edge 103 of the antenna 100 adjacent the low-band radiating element 108 to about one-third (⅓) of the way across the width of the antenna 100. The second rectangular portion 124 is narrower than the first rectangular portion 122, such that the gap 116 does not have a uniform or constant width and instead has a stepped configuration. The second rectangular portion 124 extends from the opposite edge 105 of the antenna 100 toward the other edge 103 to about two-thirds (⅔) of the way across the antenna 100 to intersect with the first rectangular portion 122.

In various embodiments, only a single port or feeding point (e.g., 125 in FIGS. 16 and 17, etc.) is needed for the antenna, which port may be located adjacent the end of the rectangular portion 124 and edge 105 of the antenna 100. Stated differently, a port or feeding point may be located at or adjacent the intersection of the gap 116 and the edge 105 of the antenna 100. Having the feeding point at the edge 105 of the antenna 100 allows the radiating elements 110 and 112 to add additional closed resonance to broaden the bandwidth for low band.

One or, more slots 126 may be introduced to configure upper radiating elements 106, 108 and help enable multi-band operation of the antenna 100. By way of example, the upper radiating elements 106, 108 and one or more slots 126 may be configured such that the upper radiating elements 106, 108 are operable as respective high and low band elements (e.g., a high band including frequencies from 1710 megahertz to 3800 megahertz, a low band including frequencies from 698 megahertz to 960 megahertz, etc.). In the illustrated example of FIG. 1, the antenna 100 includes a slot 126 having first and second generally rectangular portions 132, 134 disposed between and separating the upper radiating elements 106, 108. The illustrated first and second rectangular portions 132, 134 provide the slot 126 with a generally T-shaped configuration.

Coupling among the antenna's radiating arms or elements 106, 108, 110, 112, 114 and the gap 116 between the antenna's upper and lower portions 102, 104 allows the antenna 100 to resonate at multiple frequency bands, such as the frequency bands listed in table 1 above. The gap 116 may also help with impedance matching and is especially useful for matching at higher frequencies, e.g., 1710 megahertz to 3800 megahertz.

The one or more gaps and slots (e.g., gap 116, 216, 316, 416, slots 126, 136, 138, 226, 236, 238, 326, 336, 338, 426, 436, 438, etc.) disclosed herein are generally an absence of electrically-conductive material between radiating, elements. By way of example, an upper or lower antenna portion may be initially formed with one or more gaps and/or slots. Or, for example, one or more gaps and/or slots may be formed by removing electrically-conductive material, such as by etching, cutting, stamping, etc. In still yet other embodiments, one or more gaps and/or slots may be formed by an electrically nonconductive or dielectric material, which is added to the antenna such as by printing, etc.

As shown in FIG. 1, the "high band" radiating element 106 includes a generally rectangular shaped portion or segment 107 along the side edge 105 of the antenna 100. The portion 107 is generally perpendicular to and extends generally away from the gap 116.

The "low" band radiating element 108 includes a generally J-shaped portion or segment (e.g., three generally rectangular portions 111, 113, 115 connected so as to form or define a shape like the English alphabetic capital letter "J"). The first portion 111 of the low band radiating element 108 is along the side edge 103 of the antenna 100 opposite the high band radiating element 106. The first portion 111 is generally perpendicular to and extends generally away from the gap 116. The second portion 113 of the low band radiating element 108 is generally perpendicular to the first portion 111 and extends generally along the upper end 117 of the antenna 100. The third portion 115 of the low band radiating element 108 is generally perpendicular to the second portion 113. The third portion 115 extends along the edge 105 of the antenna 100 in a direction back towards the gap 116. The third portion 115 also extends generally toward the high band radiating element 106. But the third portion 115 is separated and spaced apart from the high band radiating element 106 by the portion 134 of the slot 126.

With continued reference to FIG. 1, the antenna's lower portion 104 (which may also be referred to as a planar skirt element), includes three elements 110, 112, 114. The three elements 110, 112, 114 have different lengths and are operable for fine tuning the frequencies resonance so that the antenna 100 has a wider bandwidth. The antenna's lower portion 104 also includes a relatively wide ground area portion 109 operable for broadbanding/increasing the bandwidth of the antenna 100. The outer elements 110 and 114 are disposed along or adjacent the respective edges 103, 105 of the antenna 100. The middle element 112 is disposed between the two outer elements 110, 114. In this example embodiment, the element 114 might be considered a ground element, and the elements 110, 112 might be considered radiating elements.

A slot 136 is between the elements 110 and 112. Another slot 138 is between the elements 112 and 114. Accordingly, the outer radiating elements 110, 114 are thus spaced apart from the middle element 112 by the slots 136, 138, respectively. A bent or protruding portion 140 of the radiating element 110 is provided that protrudes inwardly into the slot 136, which helps with fine tuning at higher frequencies.

As shown in FIG. 1, the slot 136 includes a first rectangular portion 142 connected to a narrower, shorter second rectangular portion 144. The second rectangular portion 144 extends to the lower end 146 of the antenna 100. The slot 138 includes first and second rectangular portions 148, 150 connected by a narrower third rectangular portion 152. The second rectangular portion 150 extends to the lower end 146 of the antenna 100.

The elements 110, 112, 114 are generally parallel with each other and extend generally perpendicular away from the gap 116 in a same direction (left to right in FIG. 16). As noted above, the elements 110, 112, 114 have different lengths for broadbanding or increasing the bandwidth of the antenna 100 for wide-band operation. Each element 110, 112, 114 may also have a different width or an identical width as one or more of the other elements. Each element 110, 112, 114 may have a constant width or width that changes or varies along the length of the element. For example, the element 110 is wider due to the portion 140 adjacent the end 146 of the antenna 100 than the portion of the antenna 100 alongside the first rectangular portion 142 of the slot 136.

Figure 19:
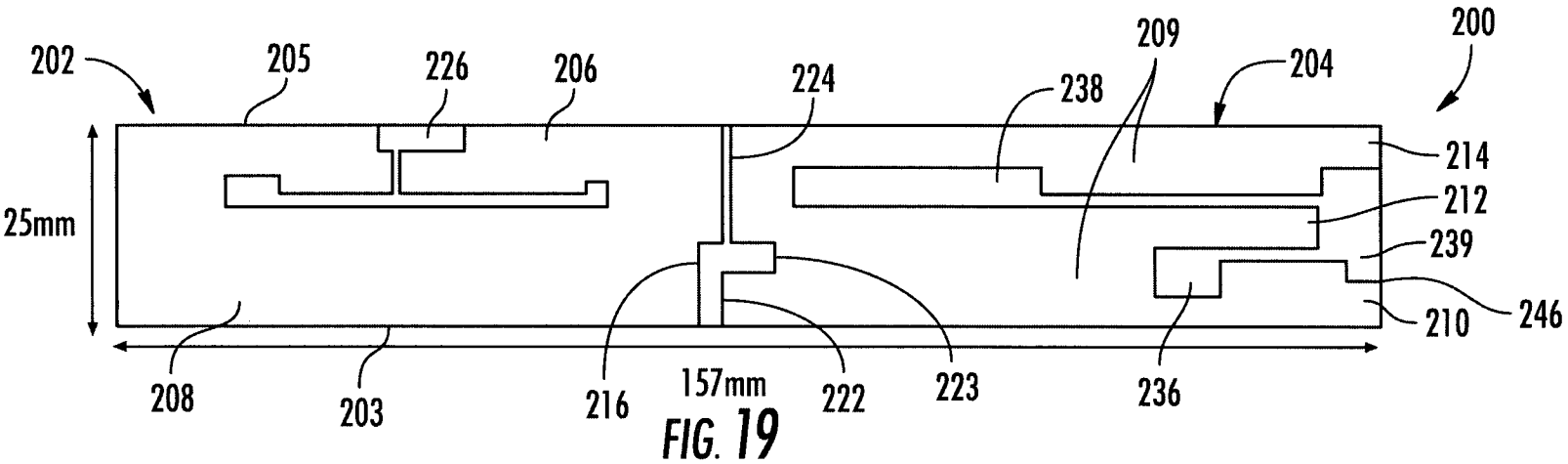
FIG. 19 illustrates another example embodiment of a multi-band, wide-band antenna including one or more aspects of the present disclosure.

In the particular embodiment shown in FIG. 1, the gap 116 and slot 126, 136, and 138 may be carefully tuned so that the antenna 100 is operable or resonates at the frequency bands listed in table 1 above. For example, as shown in FIG. 16, the antenna 100 may be operable at 750 megahertz and at 850 megahertz with the lower portion 104 and the radiating element 108 of the upper portion 102 each having an electrical wavelength of about one quarter wavelength (λ/4). As another example, FIG. 17 illustrates the antenna 100 and electrical lengths for the radiating elements at frequencies of 1950 megahertz and 2500 megahertz. As shown by FIG. 17, the antenna 100 may be operable at 1950 megahertz with the radiating element 108 of the upper portion 102 having an electrical wavelength of about three quarter wavelength (3λ/4) and with the radiating element 114 of the lower portion 104 and the radiating element 106 of the upper portion 102 having a combined electrical wavelength of about one wavelength (λ). At 2500 megahertz, the antenna 100 may be operable with the radiating element 108 of the upper portion 102 having an electrical wavelength of about one wavelength (λ) and with the radiating element 114 of the lower portion 104 having an electrical wavelength of about three quarter wavelength (3λ/4). Alternative embodiments may include radiating elements, gaps, and/or slots configured differently than that shown in FIG. 1, such as for producing different radiation patterns at different frequencies and/or for tuning to different operating bands. For example, FIGS. 19, 20, and 21 illustrate alternative embodiments of multi-band, wide-band antennas 200, 300, 400 respectively, having differently configured radiating elements, slots, and gap.

The inventors have recognized that the antenna radiation pattern may squint downward without a properly tuned gap, slots, and radiating elements. Accordingly, the inventors hereof disclose various embodiments of antennas having slots, gaps, and radiating elements that are carefully tuned so as to help inhibit the antenna radiation pattern from squinting downward and/or also to help make the radiation patterns tilt at horizontal. For example, FIGS. 3 through 12 illustrate that the radiation pattern for antenna 100 becomes less omnidirectional at azimuth plane as the frequencies increase and the antenna 100 operates as a longer dipole antenna, but the efficiency remains good. Similarly, FIGS. 22 through 27 illustrate that the radiation pattern for antenna 400 (FIG. 21) becomes less omnidirectional at azimuth plane as the frequencies increase and the antenna 400 operates as a longer dipole antenna, but the efficiency remains good. For example, FIG. 27 generally shows that the azimuth gain decreased at a frequency of 2700 megahertz as the antenna 400 tends to squint up and down and behaves as a longer dipole antenna.

The upper and lower radiating elements (e.g., 106, 108, 110, 112, 114, 206, 208, 210, 212, 214, 306, 308, 310, 312, 314, 406, 408, 410, 412, 414, etc.) disclosed herein may be made of electrically-conductive material, such as, for example, copper, silver, gold, alloys, combinations thereof, other electrically-conductive materials, etc. Further, the upper and lower radiating elements may all be made out of the same material, or one or more may be made of a different material than the others. Still further, the "high band" radiating element (e.g., 106, 206, 306, 406, etc.) may be made of a different material than the material from which the "low band" radiating element (e.g., 108, 208, 308, 408, etc.) is formed. Similarly, the lower elements (e.g., 110, 112, 114, 210, 212, 214, 310, 312, 314, 410, 412, 414, etc.) may each be made out of the same material, different material, or some combination thereof. The materials provided herein are for purposes of illustration only as an antenna may be configured from different materials and/or with different shapes, dimensions, etc. depending, for example, on the particular frequency ranges desired, presence or absence of a substrate, the dielectric constant of any substrate, space considerations, etc.

The antenna 100 may include feed locations or points (e.g., solder pads, etc.) for connection to a feed. In the illustrated example shown in FIG. 2, the feed is a coaxial cable 121 (e.g., IPEX coaxial connector, etc.) soldered 154, 155, 156 to the feed points (e.g., respective soldering pads 158, 160, 162 shown in FIG. 18, etc.) of the antenna 100. More specifically, an inner or center conductor 164 of the coaxial cable 121 is soldered 154 to a feed location (e.g., soldering pad 158, etc.) of the upper radiating portion 102. The outer conductor or braid 130 of the coaxial cable 121 is soldered 154, 156 to the lower portion 104 (e.g., soldering pads 160, 162, etc.). The outer conductor 130 may be soldered along a length of the outer element 114, along a portion of the length of the outer element 114, or soldered at multiple locations along the length of the outer element 114 as shown in FIG. 2 and/or directly to the substrate 166, for example, to provide additional strength and/or reinforcement to the connection of the coaxial cable 121. Alternative embodiments may include other feeding arrangements, such as other types of feeds besides coaxial cables and/or a feed at a different location (e.g., along the middle element 112, etc.) and/or other types of connections besides soldering, such as snap connectors, press fit connections, etc.

As shown in FIG. 1, the upper and lower radiating elements 106, 108, 110, 112, 112 are all supported on the same side of a substrate 166. Accordingly, this illustrated embodiment of the antenna 100 allows the radiating elements to be on the same side, thus eliminating the need for a double-sided printed circuit board. The elements may be fabricated or provided in various ways and supported by different types of substrates and materials, such as a circuit board, a flexible circuit board, a plastic carrier, Flame Retardant 4 or FR4, flex-film, etc. In various exemplary embodiments, the antenna substrate 166 comprises a flex material or dielectric or electrically non-conductive printed circuit board material. In embodiments in which the substrate 166 is formed from a relatively flexible material, the antenna 100 may be flexed or configured so as to follow the contour or shape of the antenna housing profile. The substrate 166 may be formed from a material having low loss and dielectric properties. According to some embodiments the antenna 100 may be, or may be part of a printed circuit board (whether rigid or flexible) where the radiating elements are all conductive traces (e.g., copper traces, etc.) on the circuit board substrate. The antenna 100 thus may be a single sided PCB antenna. Alternatively, the antenna 100 (whether mounted on a substrate or not) may be constructed from sheet metal by cutting, stamping, etching, etc. The substrate 166 may be sized differently depending, for example, on the particular application as varying the thickness and dielectric constant of the substrate may be used to tune the frequencies. By way of example, the substrate 166 may have a length of about 150 millimeters, a width of about 30 millimeters, and a thickness of about 0.80 millimeters. Alternative embodiments may include a substrate with a different configuration (e.g., different shape, size, material, etc.). The materials and dimensions provided herein are for purposes of illustration only as an antenna may be configured from different materials and/or with different shapes, dimensions, etc. depending, for example, on the particular frequency ranges desired, presence or absence of a substrate, the dielectric constant of any substrate, space considerations, etc.

FIGS. 3 through 12 illustrate analysis results measured for a prototype of the antenna 100 (FIG. 1) with the coaxial cable feed 121 shown in FIG. 2. These measured analysis results shown in FIGS. 3 through 12 are provided only for purposes of illustration and not for purposes of limitation. Generally, these results show that the multi-band, wide-band antenna 100 is operable for covering all of the frequency bands listed in table 1 above with good voltage standing wave ratios (VSWR) and with relatively good gain. As shown by these figures, the radiation pattern at azimuth plane for antenna 100 is omnidirectional for frequencies within a first frequency range (e.g., from 698 megahertz to 960 megahertz). For higher frequencies within a second frequency range (e.g., from 1710 megahertz to 3800 megahertz), the radiation pattern at azimuth plane for the antenna 100 become less omnidirectional at azimuth plane when the frequencies increase but the efficiency remains good.

Figure 3:
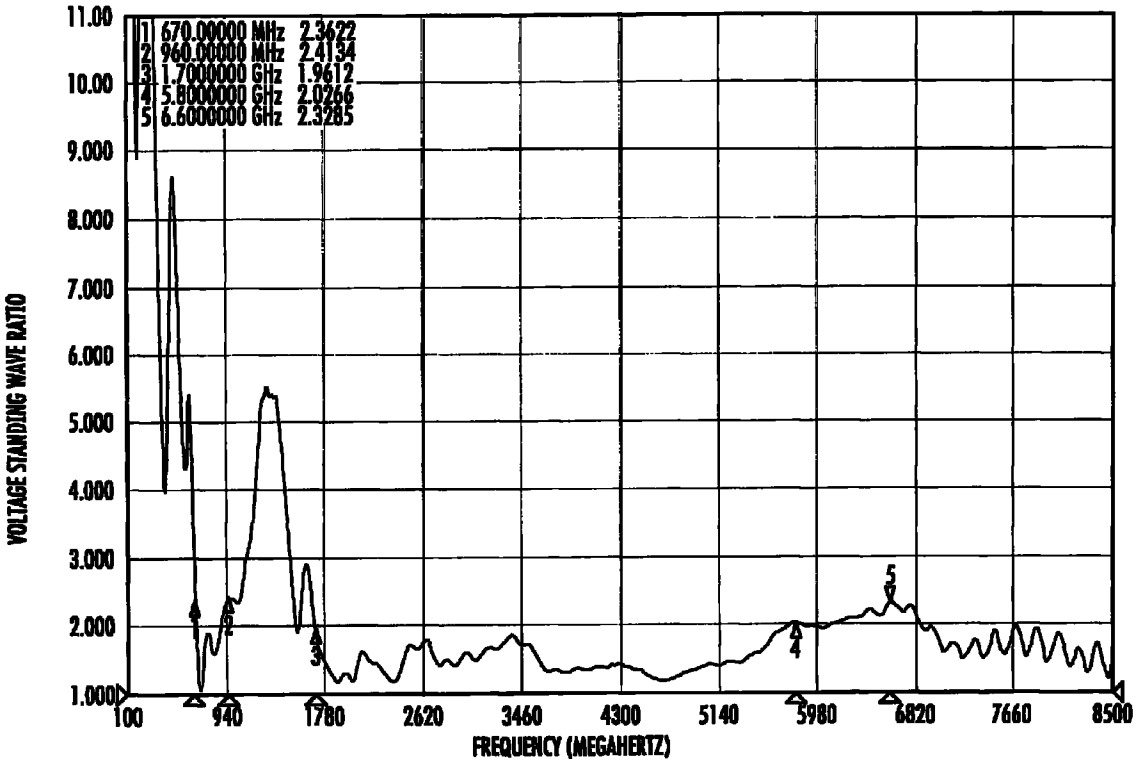
FIG. 3 is a line graph illustrating Voltage Standing Wave Ratio (VSWR) measured for a prototype of the example antenna with the coaxial cable feed shown in FIG. 2 over a frequency range of 670 megahertz (MHz) to 6.6 gigahertz (GHz)

FIG. 3 is a line graph illustrating VSWR measured for a prototype of the antenna 100 fed with a coaxial cable feed 121 over a frequency range of 670 megahertz to 6.6 gigahertz. As shown by FIG. 3, the VSWR for the antenna 100 was less than 2.5 at the frequencies of 670 megahertz (where the VSWR was 2.3622) and 960 megahertz (where the VSWR was 2.4134). The VSWR was less than 2 at a frequency of 1700 megahertz at which the VSWR was 1.9612 decibels. The VSWR was less than 2.5 for the frequencies of 5800 megahertz (where the VSWR was 2.0266 decibels) and 6600 megahertz (where the VSWR was 2.3285).

Figure 4:
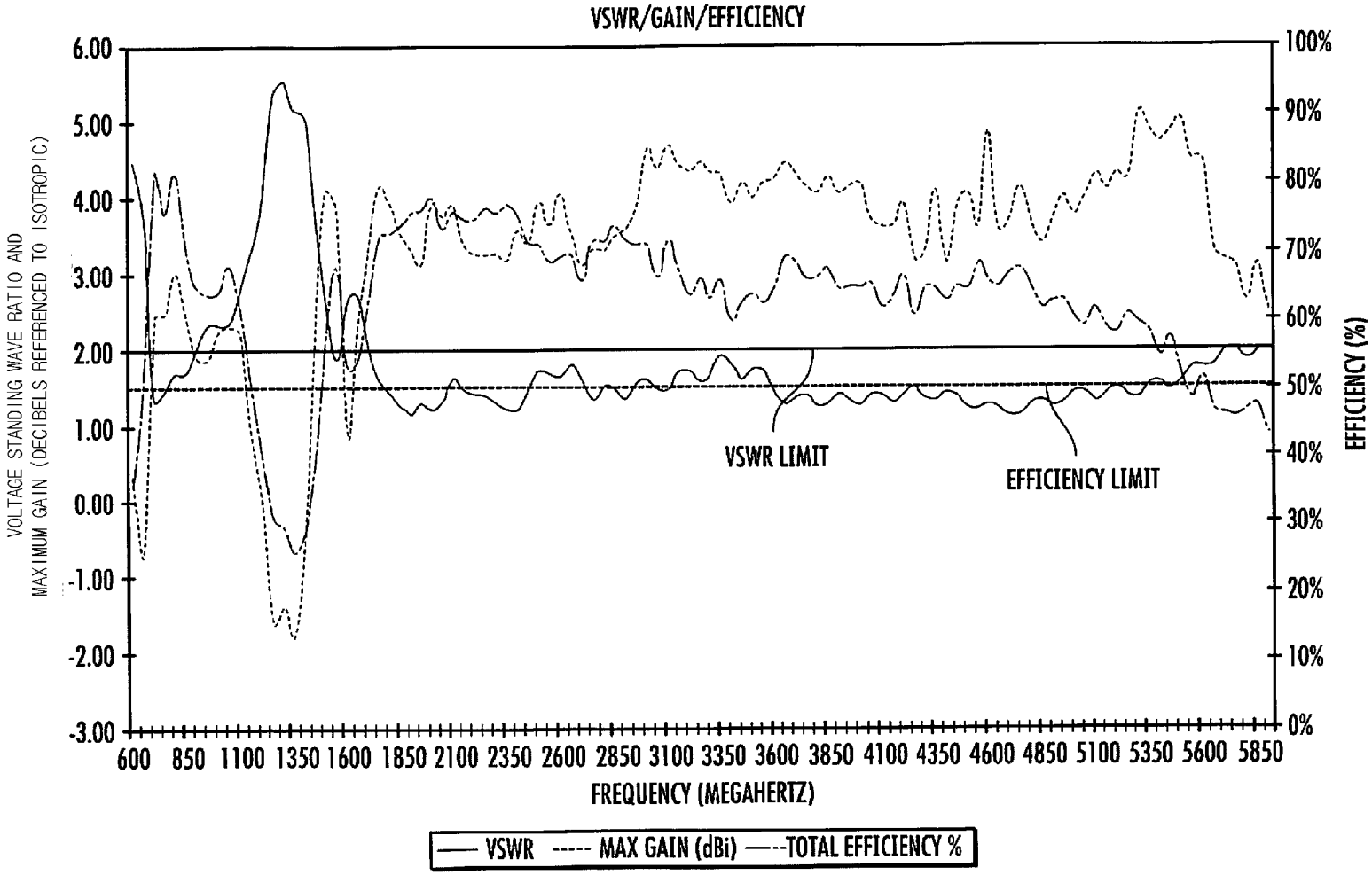
FIG. 4 is a line graph illustrating Voltage Standing Wave Ratio (VSWR), Maximum Gain in decibels referenced to isotropic (dBi), and Total Efficiency (percentage) measured for a prototype of the example antenna with the coaxial cable feed shown in FIG. 2 over a frequency range of 600 megahertz to 5.850 gigahertz.
Figure 5:
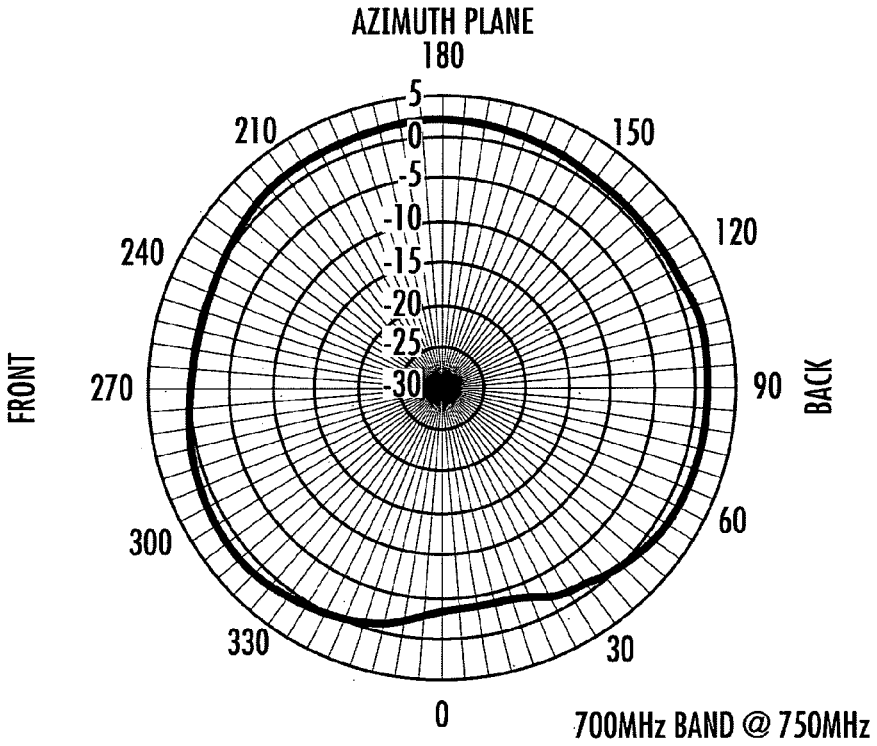
FIG. 5 illustrates radiation patterns (azimuth plane) measured for a prototype of the example antenna with the coaxial cable feed shown in FIG. 2 at a frequency of 750 megahertz which frequency is within the 700 megahertz band.
Figure 6:
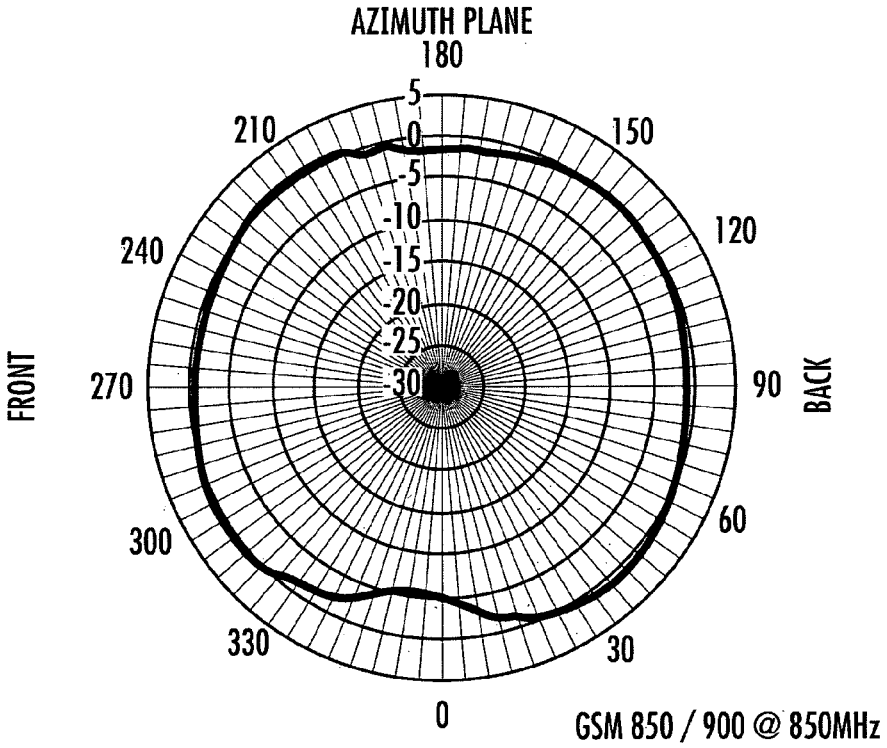
FIG. 6 illustrates radiation patterns (azimuth plane) measured for a prototype of the example antenna with the coaxial cable feed shown in FIG. 2 at a frequency of 850 megahertz which frequency is associated with GSM 850/900 (Global System for Mobile Communications 850/900)
Figure 7:
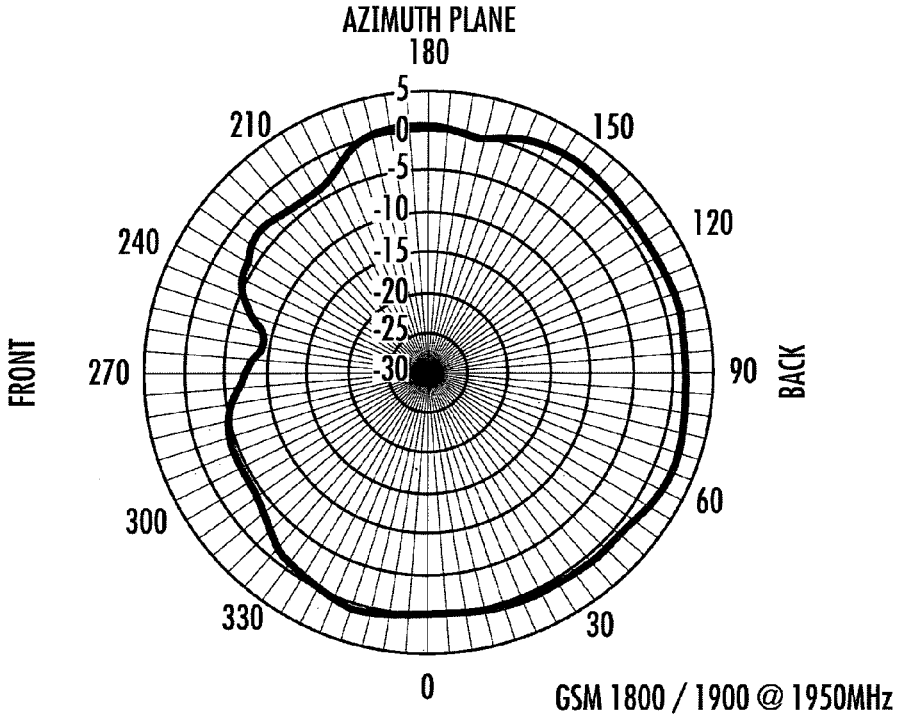
FIG. 7 illustrates radiation patterns (azimuth plane) measured for a prototype of the example antenna with the coaxial cable feed shown in FIG. 2 at a frequency of 1950 megahertz which frequency is associated with GSM 1800/1900.
Figure 8:
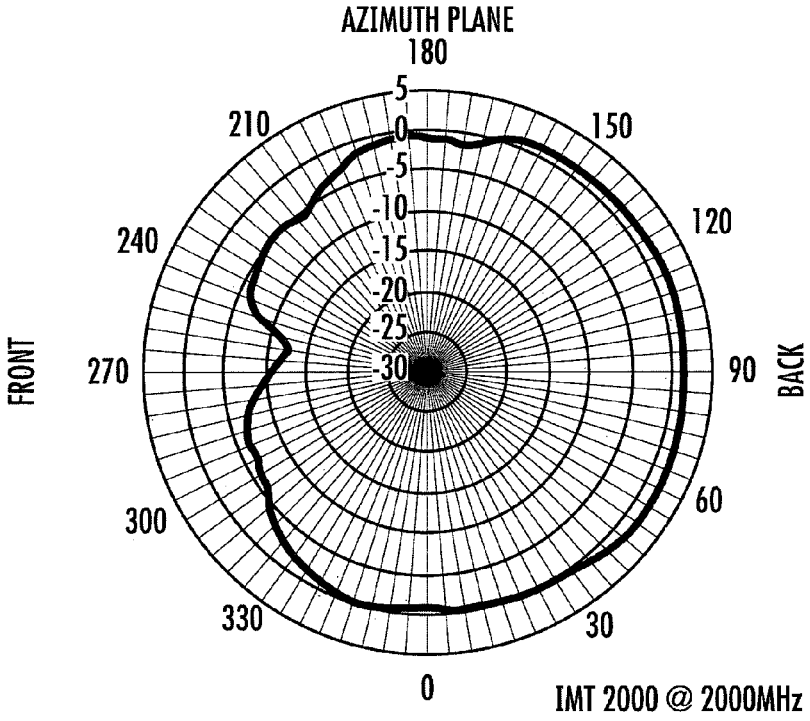
FIG. 8 illustrates radiation patterns (azimuth plane) measured for a prototype of the example antenna with the coaxial cable feed shown in FIG. 2 at a frequency of 2000 megahertz which frequency is associated with IMT 2000 (International Mobile Telecommunications 2000 band also commonly known as the third generation (3G) wireless technology)
Figure 9:
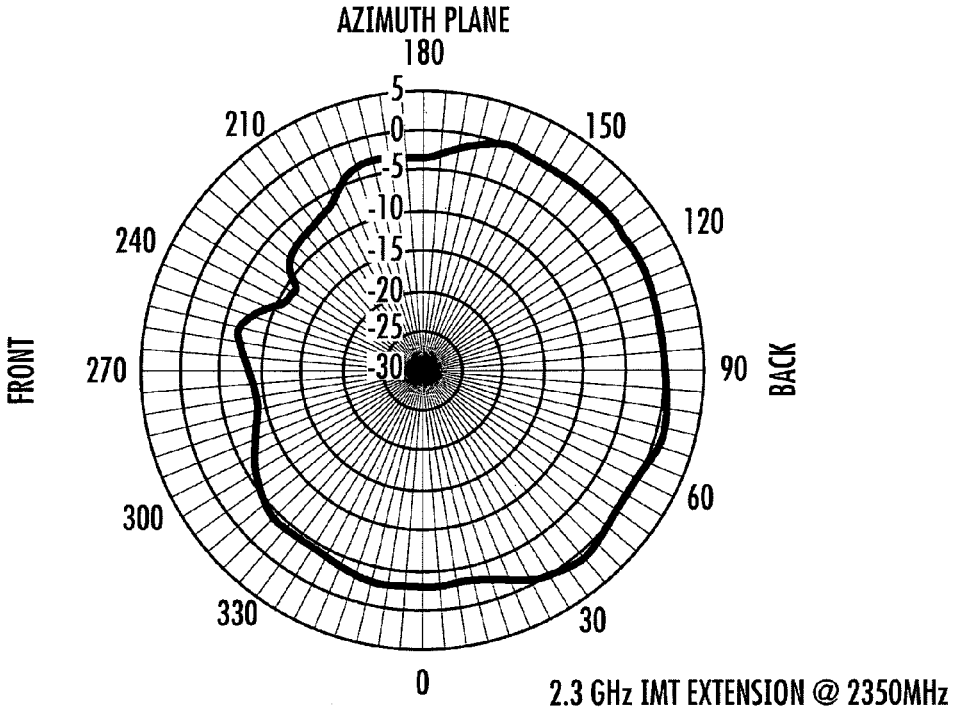
FIG. 9 illustrates radiation patterns (azimuth plane) measured for a prototype of the example antenna with the coaxial cable feed shown in FIG. 2 at a frequency of 2350 megahertz which frequency is associated with 2.3 GHz IMT Extension.
Figure 10:
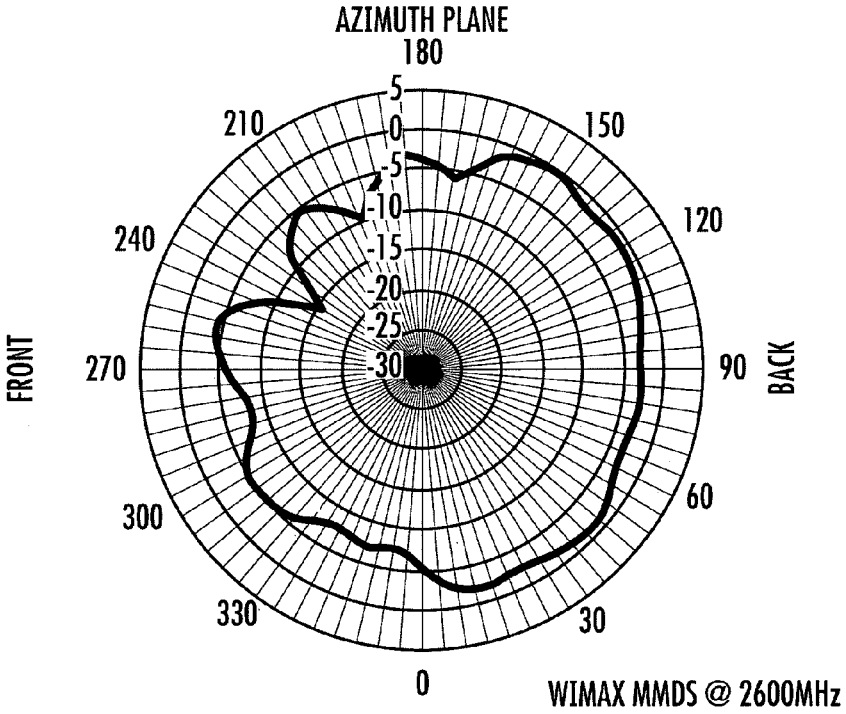
FIG. 10 illustrates radiation patterns (azimuth plane) measured for a prototype of the example antenna with the coaxial cable feed shown in FIG. 2 at a frequency of 2600 megahertz which frequency is associated with WiMAX MMDS (Worldwide Interoperability for Microwave Access Multipoint Multichannel Distribution Service)
Figure 11:
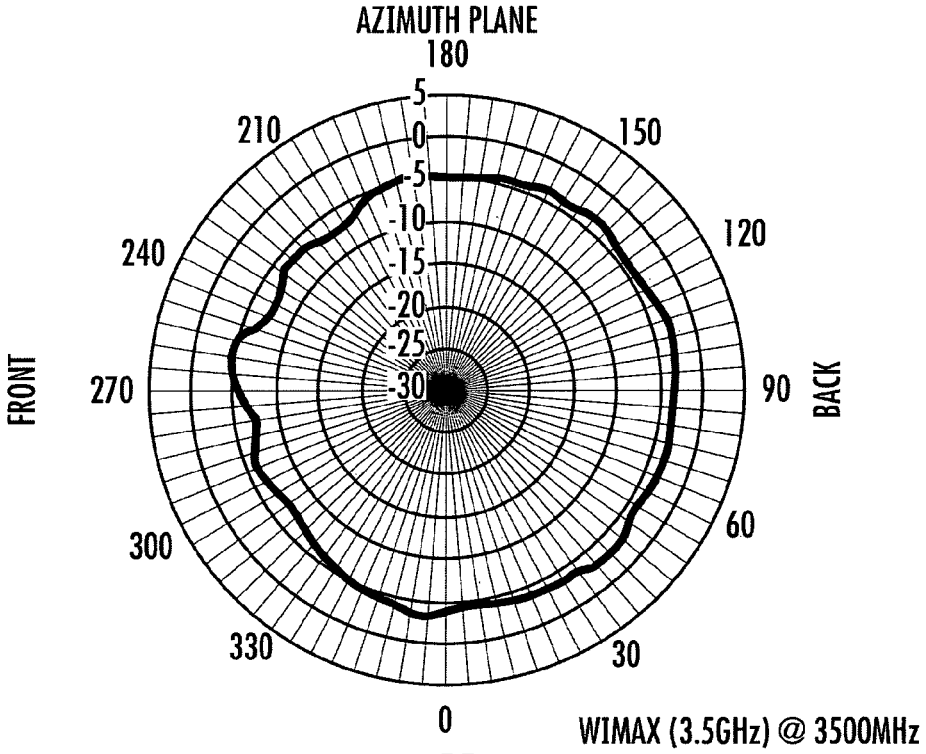
FIG. 11 illustrates radiation patterns (azimuth plane) measured for a prototype of the example antenna with the coaxial cable feed shown in FIG. 2 at a frequency of 3500 megahertz which frequency is associated with WiMAX (3.5 GHz)
Figure 12:
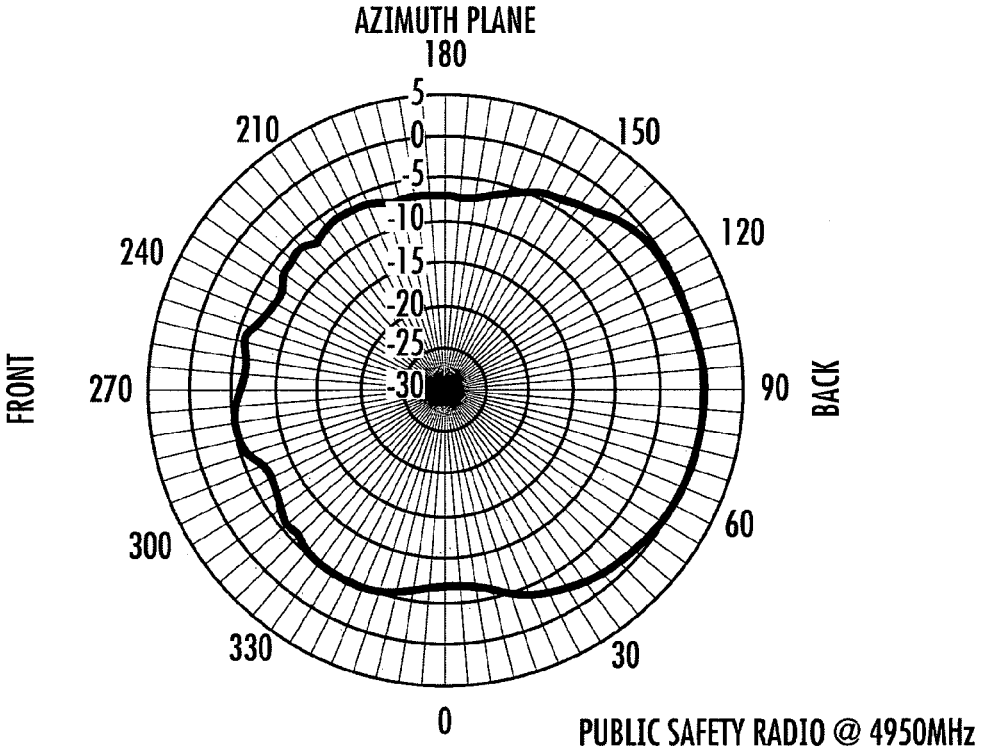
FIG. 12 illustrates radiation patterns (azimuth plane) measured for a prototype of the example antenna with the coaxial cable feed shown in FIG. 2 at a frequency of 4950 megahertz which frequency is associated with Public Safety Radio.

FIG. 4 is a line graph illustrating VSWR, Maximum Gain in decibels referenced to isotropic (dBi), and Total Efficiency (percentage) measured for a prototype of the antenna 100 fed with a coaxial cable feed 121 over a frequency range of 600 megahertz to 5.850 gigahertz. FIGS. 5 through 12 illustrates radiation patterns (azimuth plane) measured for a prototype of the 100 antenna with a coaxial cable feed 121 at various frequencies, specifically:

750 megahertz (FIG. 5) which frequency is within the 700 megahertz band;

850 megahertz (FIG. 6) which frequency is associated with GSM 850/900 (Global System for Mobile Communications 850/900);

1950 megahertz (FIG. 7) which frequency is associated with GSM 1800/1900;

2000 megahertz (FIG. 8) which frequency is associated with IMT 2000 (International Mobile Telecommunications 2000 band also commonly known as the third generation (3G) wireless technology);

2350 megahertz (FIG. 9) which frequency is associated with 2.3 GHz IMT Extension;

2600 megahertz (FIG. 10) which frequency is associated with WiMAX MMDS (Worldwide Interoperability for Microwave Access Multipoint Multichannel Distribution Service);

3500 megahertz (FIG. 11) which frequency is associated with WiMAX (3.5 GHz); and 4950 megahertz (FIG. 12) which frequency is associated with Public Safety Radio.

Figure 18:
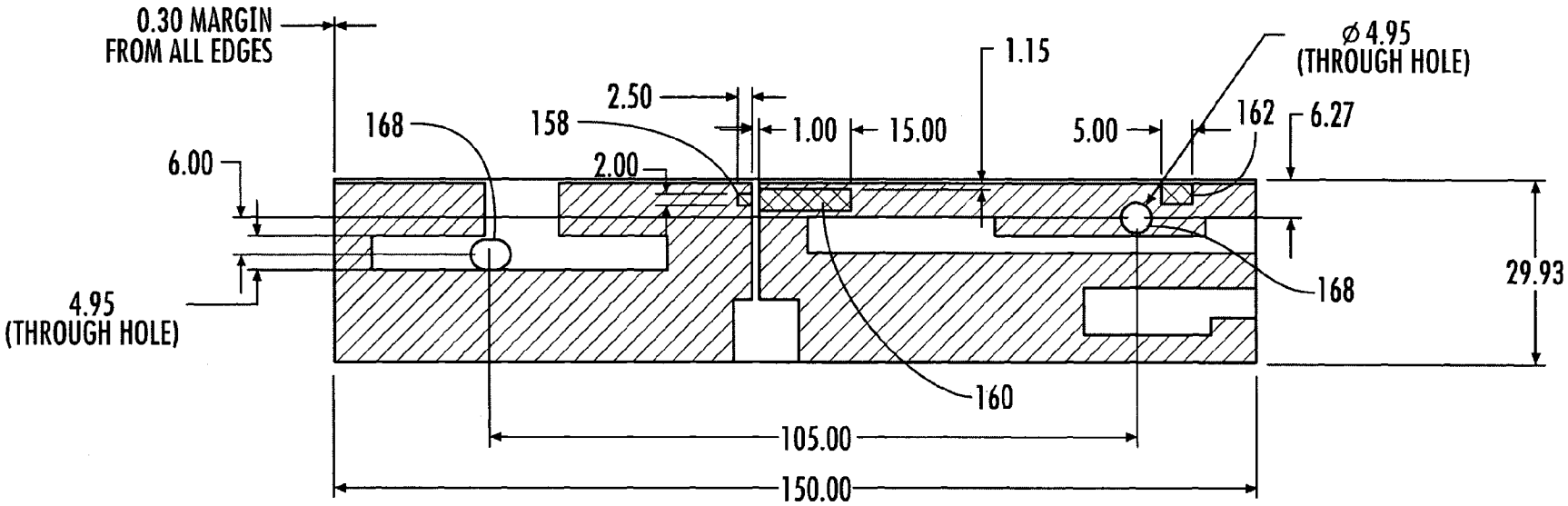
FIG. 18 illustrates the antenna shown in FIG. 1 with exemplary dimensions (in millimeters), where these dimensions are provided for purposes of illustration only according to exemplary embodiments.

By way of example, FIG. 18 illustrates exemplary dimensions in millimeters for the antenna 100 according to an exemplary embodiment, where these dimensions are provided for purposes of illustration only and not for purposes of limitation. FIG. 18 also illustrates exemplary soldering pads 158, 160, 162 that may be used when soldering a coaxial cable 121 to the antenna 100 for feeding the antenna 100. Also shown in FIG. 18 are through holes 168, which may be used with screws or other mechanical fasteners for mounting the antenna 100, such as to a computer chassis. The holes 168 may be drilled through the antenna (preferably through the substrate), or the holes 168 may be formed via another suitable process. Alternative embodiments may include an antenna configured (e.g., shaped, sized, etc.) differently than what is shown in FIG. 18 and/or an antenna with or without soldering pads and/or through holes.

FIGS. 19, 20, and 21 illustrate three other exemplary embodiments of multi-band, wide-band antennas 200, 300, and 400, respectively, according to one or more aspects of the present disclosure. The antennas 200, 300, and 400 have differently configured radiating elements, slots, and gap than the antenna 100. As shown by a comparison of FIGS. 1, 19, 20, and 21, there are differences in the shapes of the radiating elements, slots, and gaps of the respective antennas 100, 200, 300, 400 as compared to each other. Despite the differences, the antennas 200, 300, and 400 may be configured to operate in a manner generally similar or identical to the manner in which the antenna 100 operates. For example, the antennas 200, 300, and 400 may also be operable, resonate, or cover the various frequencies listed above in Table 1.

The antennas 200, 300, and 400 may be configured such that they operate with similar electrical lengths as described above for antenna 100. But the antennas' length dimension may be different than antenna 100 especially for the lower, first frequency range. By way of example, the antennas 200 and 300 may be optimized to operate for first and second frequency ranges of 698-960 megahertz and 1710-2700 megahertz with a narrower printed circuit board. In such example embodiments, the reduced width of the printed circuit board tends to shift the high band to higher frequencies. Thus, the step gap 216, 316 of the antennas 200, 300, respectively, may be changed to shift the high band back to lower frequencies even though this may result in a narrower band width for the second frequency range.

As shown in FIG. 19, the antenna 200 includes upper and lower portions 202, 204 having multiple radiating elements or arms. More specifically, the upper portion 202 includes two radiating elements or arms 206, 208. The lower portion 204 includes three radiating elements or arms 210, 212, 214.

In operation, the antenna 200 may be operable essentially as or similar to a standard half wavelength dipole antenna for frequencies falling within a first frequency range or band (e.g., frequencies from 698 megahertz to 960 megahertz, etc.) with the upper and lower portions 202, 204 each having an electrical length of about $\lambda/4$. Only radiating element 208 is essentially radiating for frequencies within the first frequency range for upper portion and having an electrical wavelength of about one quarter wavelength ($\lambda/4$) at 750 megahertz and at 850 megahertz. By way of example, the antenna 200 may be configured to be operable at 750 megahertz and at 850 megahertz with the radiating elements 210, 212, 214 of the lower portion 204 and the radiating element 208 of the upper portion 202 each having an electrical wavelength of about one quarter wavelength ($\lambda/4$).

For the higher frequencies within a second frequency range or high band (e.g., frequencies from 1710 megahertz to 2700 megahertz, etc.), both radiating elements 206, 208 of the upper portion 202 may be effective radiators. For example, at a frequency of 1950 megahertz, the antenna 200 may be operable with the radiating element 208 of the antenna's upper portion 202 has an electrical wavelength of about three quarter wavelength ($3\lambda/4$) and with the radiating element 214 of the lower portion 204 and the radiating element 206 of the upper portion 202 have a combined electrical wavelength of about one wavelength ($\lambda$). At 2500 megahertz, the antenna 200 may be operable with the radiating element 208 of the upper portion 202 having an electrical wavelength of about one wavelength (λ) and with the radiating element 214 of the lower portion 204 having electrical wavelengths of about three quarter wavelength (3λ/4).

At the first and second frequency ranges, the lower portion 204 may be operable as ground, which permits the antenna 200 to be ground independent. Thus, the antenna 200 does not depend on a separate ground element or ground plane. At low band or the first frequency range (e.g., frequencies from 698 megahertz to 960 megahertz, etc.), the lower portion or planar skirt element 204 may have an electrical length of about one quarter wavelength (λ/4).

The antenna 200 also includes a gap 216 for impedance matching. The gap 216 is defined generally between the lower edge of the radiating elements 206, 208 of the antenna's upper portion 202 and the upper edge of the radiating elements 210, 212, 214 of the antenna's lower portion 204.

As shown in FIG. 19, the gap 216 includes three rectangular portions 222, 223, 224 with different widths and lengths. Thus, the gap 216 does not have a uniform or constant width and instead has a stepped configuration. The first rectangular portion 222 extends from the edge 203 of the antenna 200 and intersects or connects with the second rectangular portion 223, which is wider (from left to right in FIG. 19) and shorter (from top to bottom in FIG. 19) than the first rectangular portion 222. The second rectangular portion 223, in turn, intersects or connects with the longer, narrower third rectangular portion 224. The third rectangular portion 224 extends from the opposite edge 205 of the antenna 200 toward the other edge 203 to intersect with the second rectangular portion 223.

A port or feeding point may be located adjacent the end of the rectangular portion 224 and edge 205 of the antenna 200. Stated differently, a port or feeding point may be located at or adjacent the intersection of the gap 216 and the edge 205 of the antenna 200. Having the feeding point at the edge 205 of the antenna 200 allows the radiating elements 210 and 212 to add additional closed resonance to broaden the bandwidth for low band.

One or more slots 226 may be introduced to configure upper radiating elements 206, 208 and help enable multi-band operation of the antenna 200. In the illustrated example of FIG. 19, the antenna 200 includes a slot 226 separating the upper radiating elements 206, 208. The illustrated slot 226 also has a generally T-shaped configuration. Coupling among the antenna's radiating arms or elements 206, 208, 210, 212, 214 and the gap 216 between the antenna's upper and lower portions 202, 204 allows the antenna 200 to resonate at multiple frequency bands. The gap 216 may also help with impedance matching and is especially useful for matching at higher frequencies, e.g., 1710 megahertz to 2700 megahertz.

With continued reference to FIG. 19, the radiating element 206 includes a generally rectangular shaped portion or segment along the side edge 205 of the antenna 200. The radiating element 208 includes a generally J-shaped portion or segment.

The antenna's lower portion 204 includes three elements 210, 212, 214. The three elements 210, 212, 214 have different lengths and are operable for fine tuning the frequencies resonance so that the antenna 200 has a wider bandwidth. The antenna's lower portion 204 also includes a relatively wide ground area portion 209 operable for broadbanding/increasing the bandwidth of the antenna 200. The outer elements 210 and 214 are disposed along or adjacent the respective edges 203, 205 of the antenna 200. The middle element 212 is disposed between the two outer elements 210, 214. In this example embodiment, the element 214 might be considered a ground element, and the elements 210, 212 might be considered radiating elements.

The antenna 200 includes a slot portion 236 between the elements 210 and 212, a slot portion 238 between the elements 212 and 214, and a slot portion 239 that connects the two slot portions 236 and 238. Thus, the antenna 200 may be described as having multiple slots or a single slot with slot portions 236, 238, and 239, where the outer radiating elements 210, 214 are spaced apart from the middle element 212 by the respective slot portions 236, 238. In this example, the middle element 212 does not extend to the lower end 246 of the antenna 200. Instead, the end of the middle element 212 is spaced apart from the lower end 246 of the antenna 200 by the slot portion 239. The slot portions 236 and 238 include generally rectangular portions with different widths and lengths such that the slot portions 236, 238 do not have a uniform or constant width and instead have a stepped configuration.

With reference now to FIG. 20, the antenna 300 includes upper and lower portions 302, 304 having multiple radiating elements or arms. More specifically, the upper portion 302 includes two radiating elements or arms 306, 308. The lower portion 304 includes three radiating elements or arms 310, 312, 314.

In operation, the antenna 300 may be operable essentially as or similar to a standard half wavelength dipole antenna for frequencies falling within a first frequency range or band (e.g., frequencies from 698 megahertz to 960 megahertz, etc.) with the upper and lower portions 302, 304 each having an electrical length of about λ/4. Only radiating element 308 is essentially radiating for frequencies within the first frequency range for upper portion 302 and having an electrical wavelength of about one quarter wavelength (λ/4) at 750 megahertz and at 850 megahertz. By way of example, the antenna 300 may be configured to be operable at 750 megahertz and at 850 megahertz with the radiating elements 310, 312, 314 of the lower portion 304 and the radiating element 308 of the upper portion 302 each having an electrical wavelength of about one quarter wavelength (λ/4).

For the higher frequencies within a second frequency range or high band (e.g., frequencies from 1710 megahertz to 2700 megahertz, etc.), both radiating elements 306, 308 of the upper portion 302 may be effective radiators. For example, at a frequency of 1950 megahertz, the antenna 300 may be operable with the radiating element 308 of the antenna's upper portion 302 having an electrical wavelength of about three quarter wavelength (3λ/4) and with the radiating element 314 of the lower portion 304 and the radiating element 306 of the upper portion 302 having a combined electrical wavelength of about one wavelength (λ). At 2500 megahertz, the antenna 300 may be operable with the radiating element 308 of the upper portion 302 having an electrical wavelength of about one wavelength (λ) and with the radiating element 314 of the lower portion 304 having an electrical wavelength of about three quarter wavelength (3λ/4).

At the first and second frequency ranges, the lower portion 304 may be operable as ground, which permits the antenna 300 to be ground independent. Thus, the antenna 300 does not depend on a separate ground element or ground plane. At low band or the first frequency range (e.g., frequencies from 698 megahertz to 960 megahertz, etc.), the lower portion or planar skirt element 304 may have an electrical length of about one quarter wavelength (λ/4).

The antenna 300 also includes a gap 316 for impedance matching. The gap 316 is defined generally between the lower edge of the radiating elements 306, 308 of the antenna's upper portion 302 and the upper edge of the radiating elements 310, 312, 314 of the antenna's lower portion 304.

As shown in FIG. 20, the gap 316 includes three rectangular portions 322, 323, 324 with different widths and lengths. Thus, the gap 316 does not have a uniform or constant width and instead has a stepped configuration. The first rectangular portion 322 extends from the edge 303 of the antenna 300 and intersects or connects with the second rectangular portion 323. The second rectangular portion 323 is wider (from left to right in FIG. 20) and shorter (from top to bottom in FIG. 20) than the first rectangular portion 322. The second rectangular portion 323, in turn, intersects or connects with the longer, narrower third rectangular portion 324. The third rectangular portion 324 extends from the opposite edge 305 of the antenna 300 toward the other edge 303 to intersect with the second rectangular portion 323.

A port or feeding point may be located adjacent the end of the rectangular portion 324 and edge 305 of the antenna 300. Stated differently, a port or feeding point may be located at or adjacent the intersection of the gap 316 and the edge 305 of the antenna 300. Having the feeding point at the edge 305 of the antenna 300 allows the radiating elements 310 and 312 to add additional closed resonance to broaden the bandwidth for low band.

One or more slots 326 may be introduced to configure upper radiating elements 306, 308 and help enable multi-band operation of the antenna 300. In the illustrated example of FIG. 20, the antenna 300 includes a slot 326 separating the upper radiating elements 306, 308. The illustrated slot 326 also has a generally T-shaped configuration. Coupling among the antenna's radiating arms or elements 306, 308, 310, 312, 314 and the gap 316 between the antenna's upper and lower portions 302, 304 allows the antenna 300 to resonate at multiple frequency bands. The gap 316 may also help with impedance matching and is especially useful for matching at higher frequencies, e.g., 1710 megahertz to 2700 megahertz.

With continued reference to FIG. 20, the radiating element 306 includes a generally rectangular shaped portion or segment along the side edge 305 of the antenna 300. The radiating element 308 includes a generally J-shaped portion or segment.

The antenna's lower portion 304 includes three elements 310, 312, 314. The three elements 310, 312, 314 have different lengths and are operable for fine tuning the frequencies resonance so that the antenna 300 has a wider bandwidth. The antenna's lower portion 304 also includes a relatively wide ground area portion 309 operable for broadbanding/increasing the bandwidth of the antenna 300. The outer elements 310, and 314 are disposed along or adjacent the respective edges 303, 305 of the antenna 300. The middle element 312 is disposed between the two outer elements 310, 314. In this example embodiment, the element 314 might be considered a ground element, and the elements 310, 312 might be considered radiating elements.

The antenna 300 includes a slot 336 between the elements 310 and 312 and a slot portion 338 between the elements 312 and 314. Thus, the outer radiating elements 310, 314 are spaced apart from the middle element 312 by the respective slots 336, 338. The slots 336 and 338 include generally rectangular portions with different widths and lengths such that the slots do not have a uniform or constant width and instead have a stepped configuration.

FIG. 21 illustrates an exemplary embodiment of an antenna assembly that includes a multiband, wide-band antenna 400 positioned within a housing or sheath 470 and with a coaxial cable 421 soldered 454, 455, 456 to feed points or soldering pads of the antenna 400. The coaxial cable 421 is connected to an external connector 472, which, in turn, may be used for connecting the antenna assembly to an electronic device, such as a handheld portable terminal, laptop or notebook computer, etc. The example antenna assembly illustrated in FIG. 21 may be used an external blade antenna.

With continued reference to FIG. 21, the antenna 400 includes upper and lower portions 402, 404 having multiple radiating elements or arms. More specifically, the upper portion 402 includes two radiating elements or arms 406, 408. The lower portion 404 includes three radiating elements or arms 410, 412, 414.

In operation, the antenna 400 may be operable essentially as or similar to a standard half wavelength dipole antenna for frequencies falling within a first frequency range or band (e.g., frequencies from 698 megahertz to 960 megahertz, etc.) with the upper and lower portions 402, 404 each having an electrical length of about $\lambda/4$. Only radiating element 408 is essentially radiating for frequencies within the first frequency range for upper portion 402 and having an electrical wavelength of about one quarter wavelength ($\lambda/4$) at 750 megahertz and at 850 megahertz. By way of example, the antenna 400 may be configured to be operable at 750 megahertz and at 850 megahertz with the radiating elements 410, 412, 414 of the lower portion 404 and the radiating element 408 of the upper portion 402 each having an electrical wavelength of about one quarter wavelength ($\lambda/4$).

For the higher frequencies within a second frequency range or high band (e.g., frequencies from 1710 megahertz to 2700 megahertz, etc.), both radiating elements 406, 408 of the upper portion 402 may be effective radiators. For example, at a frequency of 1950 megahertz, the antenna 400 may be operable with the radiating element 408 of the antenna's upper portion 402 having an electrical wavelength of about three quarter wavelength ($3\lambda/4$) and with the radiating element 414 of the lower portion 404 and the radiating element 406 of the upper portion 402 having a combined electrical wavelength of about one wavelength ($\lambda$). At 2500 megahertz, the antenna 400 may be operable with the radiating element 408 of the upper portion 402 having an electrical wavelength of about one wavelength ($\lambda$) and with the radiating element 414 of the lower portion 404 having an electrical wavelength of about three quarter wavelength ($3\lambda/4$).

At the first and second frequency ranges, the lower portion 404 may be operable as ground, which permits the antenna 400 to be ground independent. Thus, the antenna 400 does not depend on a separate ground element or ground plane. At, low band or the first frequency range (e.g., frequencies from 698 megahertz to 960 megahertz, etc.), the lower portion or planar skirt element 404 may have an electrical length of about one quarter wavelength ($\lambda/4$).

The antenna 400 also includes a gap 416 for impedance matching. The gap 416 is defined generally between the lower edge of the radiating elements 406, 408 of the antenna's upper portion 402 and the upper edge of the radiating elements 410, 412, 414 of the antenna's lower portion 404.

As shown in FIG. 21, the gap 416 includes three rectangular portions 422, 423, 424 with different widths and lengths. Thus, the gap 416 does not have a uniform or constant width and instead has a stepped configuration. The first rectangular portion 422 extends from the edge 403 of the antenna 400 and intersects or connects with the second rectangular portion 423. The second rectangular portion 423 is narrower (from left to right in FIG. 21) and shorter (from top to bottom in FIG. 21) than the first rectangular portion 422. The second rectangular portion 423, in turn, intersects or connects with the narrower third rectangular portion 424. The third rectangular portion 424 extends from the opposite edge 405 of the antenna 400 toward the other edge 403 to intersect with the second rectangular portion 423.

A port or feeding point may be located adjacent the end of the rectangular portion 424 and edge 405 of the antenna 400. Stated differently, a port or feeding point may be located at or adjacent the intersection of the gap 416 and the edge 405 of the antenna 400. Having the feeding point at the edge 405 of the antenna 400 allows the radiating elements 410 and 412 to add additional closed resonance to broaden the bandwidth for low band.

One or more slots 426 may be introduced to configure upper radiating elements 406, 408 and help enable multi-band operation of the antenna 400. In the illustrated example of FIG. 21, the antenna 400 includes a slot 426 separating the upper radiating elements 406, 408. The illustrated slot 426 also has a generally T-shaped configuration. Coupling among the antenna's radiating arms or elements 406, 408, 410, 412, 414 and the gap 416 between the antenna's upper and lower portions 402, 404 allows the antenna 400 to resonate at multiple frequency bands. The gap 416 may also help with impedance matching and is especially useful for matching at higher frequencies, e.g., 1710 megahertz to 2700 megahertz.

With continued reference to FIG. 21, the radiating element 406 includes a generally rectangular shaped portion or segment along the side edge 405 of the antenna 400. The radiating element 408 includes a generally J-shaped portion or segment.

The antenna's lower portion 404 includes three elements 410, 412, 414. The three elements 410, 412, 414 different lengths and are operable for fine tuning the frequencies resonance so that the antenna 400 has a wider bandwidth. The antenna's lower portion 404 also includes a relatively wide ground area portion 409 operable for broadbanding/increasing the bandwidth of the antenna 400. The outer elements 410 and 414 are disposed along or adjacent the respective edges 403, 405 of the antenna 400. The middle element 412 is disposed between the two outer elements 410, 414. In this example embodiment, the element 414 might be considered a ground element, and the elements 410, 412 might be considered radiating elements.

The antenna 400 includes a slot 436 between the elements 410 and 412 and a slot portion 438 between the elements 412 and 414. Thus, the outer radiating elements 410, 414 are spaced apart from the middle element 412 by the respective slots 436, 438. The slots 436 and 438 include generally rectangular portions with different widths and lengths such that the slots do not have a uniform or constant width and instead have a stepped configuration.

FIGS. 22 through 27 illustrate analysis results measured for a prototype of the antenna 400 (FIG. 21) with a coaxial cable feed. These measured analysis results shown in FIGS. 22 through 27 are provided only for purposes of illustration and not for purposes of limitation. Generally, these results show that the radiation pattern for antenna 400 (FIG. 21) becomes less omnidirectional at azimuth plane as the frequencies increase and the antenna 400 operates as a longer dipole antenna, but the efficiency remains good. For example, FIG. 27 generally shows that the azimuth gain decreased at a frequency of 2700 megahertz as the antenna 400 tends to squint up and down and behaves as a longer dipole antenna.

The various radiating elements disclosed herein may be made of electrically-conductive material, such as, for example, copper, silver, gold, alloys, combinations thereof, other electrically-conductive materials, etc. Further, the upper and lower elements may all be made out of the same material, or one or more of the elements may be made of a different material than the others. Still further, one of the upper radiating elements may be made of a different material than the material from which the other upper radiating element is formed. Similarly, the lower elements may each be made out of the same material, different material, or some combination thereof. The materials provided herein are for purposes of illustration only as an antenna may be configured from different materials and/or with different shapes, dimensions, etc. depending, for example, on the particular frequency ranges desired, presence or absence of a substrate, the dielectric constant of any substrate, space considerations, etc.

In the various exemplary embodiments of the antennas disclosed herein (e.g., antenna 100 (FIG. 1), antenna 200 (FIG. 19), antenna 300 (FIG. 20), antenna 400 (FIG. 21), etc.), the radiating elements may all be supported on the same side of a substrate. Allowing all the radiating elements to be on the same side of the substrate eliminates the need for a double-sided printed circuit board. The radiating elements disclosed herein may be fabricated or provided in various ways and supported by different types of substrates and materials, such as a circuit board, a flexible circuit board, sheet metal, a plastic carrier, Flame Retardant 4 or FR4, flex-film, etc. Various exemplary embodiments include a substrate comprising a flex material or dielectric or electrically non-conductive printed circuit board material. In exemplary embodiments that include a substrate formed from a relatively flexible material, the antenna may be flexed or configured so as to follow the contour or shape of the antenna housing profile. The substrate may be formed from a material having low loss and dielectric properties. According to some embodiments, an antenna disclosed herein may be, or may be part of a printed circuit board (whether rigid or flexible) where the radiating elements are all conductive traces (e.g., copper traces, etc.) on the circuit board substrate. In which case, the antenna thus may be a single sided PCB antenna. Alternatively, the antenna (whether mounted on a substrate or not) may be constructed from sheet metal by cutting, stamping, etching, etc. In various exemplary embodiments, the substrate may be sized differently depending, for example, on the particular application as varying the thickness and dielectric constant of the substrate may be used to tune the frequencies. By way of example, a substrate (e.g., FIG. 18, etc.) may have a length of about 150 millimeters, a width of about 30 millimeters, and a thickness of about 0.80 millimeters. Alternative embodiments may include a substrate with a different configuration (e.g., different shape, size, material, etc.). For example, FIG. 19 illustrates a substrate having a length of 157 millimeters and a width of 25 millimeters. As another example, FIG. 20 illustrates a substrate having a length of 167 millimeters and a width of 20 millimeters. The materials and dimensions provided herein are for purposes of illustration only as an antenna may be made from different materials and/or configured with different shapes, dimensions, etc. depending, for example, on the particular frequency ranges desired, presence or absence of a substrate, the dielectric constant of any substrate, space considerations, etc.

As is evident by the various configurations of the illustrated antennas 100 (FIG. 1), 200 (FIG. 19), 300 (FIG. 20), and antenna 400 (FIG. 21), antenna embodiments may be varied without departing from the scope of this disclosure and the specific configurations disclosed herein are exemplary embodiments only and are not intended to limit this disclosure. For example, as shown by a comparison of FIGS. 1, 19, 20, and 21, the size, shape, length, width, inclusion, etc. of the radiating elements, gaps, and/or slots may be varied. One or more of these features may be changed to adapt an antenna to different frequency ranges, to the different dielectric constants of any substrate (or the lack of any substrate), to increase the bandwidth of one or more resonant radiating elements, to enhance one or more other features, etc.

The various antennas (e.g., 100 (FIG. 1), 200 (FIG. 19), 300 (FIG. 20), antenna 400 (FIG. 21), etc.) disclosed herein may be integrated in, embedded in, installed to, mounted on, externally mounted or supported on a portable terminal or wireless application device, including, for example, a personal computer, a cellular phone, personal digital assistant (PDA), etc. within the scope of the present disclosure. By way of example, an antenna disclosed herein may be mounted to a wireless application device (whether inside or outside the device housing) by means of double sided foam tape or screws. If mounted with screws or other mechanical fasteners, holes (e.g., through holes 168 (FIG. 18), etc.) may be drilled through the antenna (preferably through the substrate). The antenna may also be used as an external antenna. The antenna may be mounted in its own housing, and a coaxial cable may be terminated with a connector (e.g., SMA (SubMiniature Type A) connector, MMCX (micro-miniature coaxial) connector, MCC or mini coaxial connector, U.FL connector, etc.) for connecting to an external antenna connector of a wireless application device or portable terminal. Such embodiments permit the antenna to be used with any suitable wireless application device or portable terminal without needing to be designed to fit inside the wireless application device housing or portable terminal. By way of example, FIGS. 13 through 15 illustrate exemplary applications in which may be used one or more of the disclosed embodiments of a multiband, wide-band antenna, such as antenna 100 (FIG. 1), antenna 200 (FIG. 19), antenna 300 (FIG. 20), antenna 400 (FIG. 21), etc. More specifically, FIG. 13 illustrates a desktop antenna that may include a multiband, wide-band antenna. FIG. 14 illustrates an external blade antenna that may include a multiband, wide-band antenna. And, FIG. 15 illustrates a multiband, wide-band antenna as an internal embedded antenna.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and, all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below,", "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter. The disclosure of a first value and a second value for a given parameter can be interpreted as disclosing that any value between the first and second values could also be employed for the given parameter. Similarly, it is envisioned that disclosure of two or more ranges of values for a parameter (whether such ranges are nested, overlapping or distinct) subsume all possible combination of ranges for the value that might be claimed using endpoints of the disclosed ranges.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A multi-band, wide-band antenna comprising:

an upper portion including two or more upper radiating elements and one or more slots disposed between the two or more upper radiating elements;

a lower portion including two or more lower radiating elements and one or more slots disposed between the two or more lower radiating elements;

a gap having two open ends between the upper and lower portions such that the upper radiating elements are separated and spaced apart from the lower radiating elements, the gap including a plurality of rectangular portions defining a stepped configuration, wherein the plurality of rectangular portions of the gap comprises a first rectangular portion and a second rectangular portion that is narrower than the first rectangular portion, the second rectangular portion extending from an edge of the antenna towards an opposite edge of the antenna to intersect with the first rectangular portion;

whereby coupling of the gap and the upper and lower radiating elements enable multi-band, wide-band operation of the antenna within at least a first frequency range and a second frequency range, with the upper radiating elements operable as a radiating portion of the antenna, the lower radiating elements operable as a ground portion, and the gap operable for impedance matching.

2. The antenna of claim 1, wherein:

the plurality of rectangular portions of the gap further comprises a third rectangular portion that extends from the opposite edge of the antenna towards the edge of the antenna to intersect with the first rectangular portion; and/or the antenna includes a feeding point at the edge of the antenna adjacent the gap, such that one or more of the lower radiating elements are operable for adding additional closed resonance to broaden the bandwidth for at least the first frequency range.

3. The antenna of claim 1, wherein:

the gap is defined between a lower edge of the two or more upper radiating elements having a step configuration and an upper edge of the two or more lower radiating elements having a step configuration; and the first and second rectangular portions are defined between the lower edge of the two or more upper radiating elements and the upper edge of the two or more lower radiating elements, the first and second rectangular portions extending from opposite side edges of the antenna across a width of the antenna.

4. The antenna of claim 1, wherein:

the two or more upper radiating elements include a first radiating element having a generally rectangular configuration, and a second radiating element having a generally J-shaped configuration; and/or the one or more slots of the upper portion include a generally T-shaped slot between the first and second radiating elements.

5. The antenna of claim 1, wherein:

the two or more lower radiating elements comprise three or more lower radiating elements that include first, second, and third radiating elements, the second radiating element being disposed between the outer first and third radiating elements; and the one or more slots of the lower portion include at least one slot such that at least one slot portion is between the first and second radiating elements and at least one slot portion is between the second and third radiating elements.

6. The antenna of claim 5, wherein at least one of the three or more lower radiating elements include a bent portion that protrudes inwardly into the at least one slot and configured to help with fine tuning at frequencies within the second, higher frequency range.

7. The antenna of claim 1, wherein the two or more lower radiating elements are configured with different lengths for broadbanding the bandwidth of the antenna for at least the first frequency range.

8. The antenna of claim 1, wherein:

the one or more slots of the upper portion includes a plurality of rectangular slot portions defining a stepped configuration; and/or the one or more slots of the lower portion include a plurality of rectangular slot portions defining a stepped configuration.

9. An electronic device comprising an external blade antenna including the antenna of claim 1 and externally mounted to the electronic device, wherein the antenna is configured to resonate at:

the first frequency range from about 698 megahertz to about 960 megahertz; and/or at the second frequency range from about 1710 megahertz to about 2700 or 3800 megahertz.

10. The antenna of claim 1, wherein the antenna is configured such that:

the antenna has a Voltage Standing Wave Ratio (VSWR) less than 2.5 for frequencies from about 698 megahertz to about 960 megahertz; and/or the antenna has a VSWR less than 2 for frequencies from about 1710 megahertz to about 5000 megahertz; and/or the antenna has a VSWR less than 2.5 for frequencies from about 5000 megahertz to about 6000 megahertz.

11. The antenna of claim 1, wherein:

the antenna is configured to be operable at 750 megahertz and at 850 megahertz with the lower radiating elements of the lower portion and the second radiating element of the upper portion each having an electrical length of about one quarter wavelength ($\lambda/4$); and the antenna is configured to be operable at 1950 megahertz with the second radiating element of the upper portion having an electrical length of about three quarter wavelength ($3\lambda/4$) and with at least one of the lower radiating elements of the lower portion and the first radiating element of the upper portion having a combined electrical wavelength of about one wavelength ($\lambda$); and the antenna is configured to be operable at 2500 megahertz with the second radiating element of the upper portion having an electrical length of about one wavelength ($\lambda$) and with at least one of the lower radiating elements of the lower portion having an electrical wavelength of about three quarter wavelength ($3\lambda/4$).

12. The antenna of claim 1, wherein:

the lower portion comprises a planar skirt element; and/or the lower portion is configured to be operable as a quarter wavelength ($\lambda/4$) choke at the first frequency range, such that at least a portion of the antenna current is reduced from flowing on an outer surface of a coaxial cable when the antenna is being fed by the coaxial cable; and/or the lower portion is configured to be operable as ground such that the antenna is ground independent and does not depend on a separate ground element or ground plane; and/or the lower portion is operable as a sleeve choke at the first frequency range.

13. The antenna of claim 1, further comprising a coaxial cable having inner and outer conductors electrically coupled to the respective upper and lower portions of the antenna, and wherein the coaxial cable is positioned along a length of one of the two or more lower radiating elements.

14. The antenna of claim 1, wherein:

the radiating elements, gap, and slots are on the same side of a printed circuit board; and/or the antenna further comprises a substrate supporting the upper and lower portions of the antenna on the same side of the substrate; and/or the upper and lower radiating elements comprise conductive traces on a circuit board.

15. The antenna of claim 1, wherein:

the lower portion is configured to be operable as ground such that the antenna is ground independent and does not depend on a separate ground element or ground plane; and the antenna is omnidirectional.

16. A multi-band, wide-band antenna comprising:

an upper portion including two or more upper radiating elements and one or more slots disposed between the two or more upper radiating elements;

a lower portion including two or more lower radiating elements and one or more slots disposed between the two or more lower radiating elements;

a gap between the upper and lower portions such that the upper radiating elements are separated and spaced apart from the lower radiating elements, the gap including a plurality of rectangular portions and having two open ends;

wherein the plurality of rectangular portions of the gap comprises a first rectangular portion and a second rectangular portion that is narrower than the first rectangular portion, the second rectangular portion extending from an edge of the antenna towards an opposite edge of the antenna to intersect with the first rectangular portion;

wherein the one or more slots of the upper portion includes a plurality of rectangular slot portions; and wherein the one or more slots of the lower portion include a plurality of rectangular slot portions;

whereby the antenna is operable within at least a first frequency range and a second frequency range, with the upper radiating elements operable as a radiating portion of the antenna, the lower radiating elements operable as a ground portion, and the gap operable for impedance matching.

17. The antenna of claim 16, wherein:

the plurality of rectangular slot portions of the upper portion define a stepped configuration;

the plurality of rectangular slot portions of the lower portion define a stepped configuration; and the plurality of rectangular portions of the gap define a stepped configuration.

18. The antenna of claim 16, wherein:

the antenna is configured to be operable at 750 megahertz and at 850 megahertz with the lower radiating elements of the lower portion and the second radiating element of the upper portion each having an electrical length of about one quarter wavelength ($\lambda/4$); and the antenna is configured to be operable at 1950 megahertz with the second radiating element of the upper portion having an electrical length of about three quarter wavelength ($3\lambda/4$) and with at least one of the lower radiating elements of the lower portion and the first radiating element of the upper portion having a combined electrical wavelength of about one wavelength ($\lambda$); and the antenna is configured to be operable at 2500 megahertz with the second radiating element of the upper portion having an electrical length of about one wavelength ($\lambda$) and with at least one of the lower radiating elements of the lower portion having an electrical wavelength of about three quarter wavelength ($3\lambda/4$).

19. The antenna of claim 17, wherein:

the lower portion comprises a planar skirt element; and/or the lower portion is configured to be operable as a quarter wavelength ($\lambda/4$) choke at the first frequency range, such that at least a portion of the antenna current is reduced from flowing on an outer surface of a coaxial cable when the antenna is being fed by the coaxial cable; and/or the lower portion is configured to be operable as ground such that the antenna is ground independent and does not depend on a separate ground element or ground plane; and/or the lower portion is operable as a sleeve choke at the first frequency range; and/or the plurality of rectangular portions of the gap further comprises a third rectangular portion that extends from the opposite edge of the antenna towards the edge of the antenna to intersect with the first rectangular portion.

20. The antenna of claim 16, wherein:

the gap is defined between a lower edge of the two or more upper radiating elements having a step configuration and an upper edge of the two or more lower radiating elements having a step configuration;

the first and second rectangular portions are defined between the lower edge of the two or more upper radiating elements and the upper edge of the two or more lower radiating elements, the first and second rectangular portions extending from opposite side edges of the antenna across a width of the antenna;

the radiating elements, gap, and slots are on the same side of a printed circuit board; and the upper and lower radiating elements comprise conductive traces on a circuit board.

* * * * *